US007206527B2

(12) United States Patent
Sasamoto et al.

(10) Patent No.: US 7,206,527 B2
(45) Date of Patent: Apr. 17, 2007

(54) INFORMATION FORMING APPARATUS EQUIPPED WITH A FIXING UNIT

(75) Inventors: Yoshihito Sasamoto, Hachioji (JP); Atsushi Takahashi, Akishima (JP); Norio Joichi, Kokubunji (JP); Youbao Peng, Hino (JP); Akifumi Isobe, Hidaka (JP); Yoshiki Katayama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 287 days.

(21) Appl. No.: 10/895,914

(22) Filed: Jul. 22, 2004

(65) Prior Publication Data

US 2005/0058467 A1 Mar. 17, 2005

(30) Foreign Application Priority Data

Sep. 17, 2003 (JP) ..... 2003-324545
Apr. 14, 2004 (JP) ..... 2004-119203

(51) Int. Cl.
*G03G 15/00* (2006.01)
*G03G 15/20* (2006.01)

(52) U.S. Cl. ..... 399/37; 399/67

(58) Field of Classification Search ..... 399/37, 399/67, 88

See application file for complete search history.

(56) References Cited

U.S. PATENT DOCUMENTS 4,372,675 A * 2/1983 Sahay ..... 399/88
4,569,585 A * 2/1986 Masuda ..... 399/37
6,763,204 B2 * 7/2004 Kondo et al. ..... 399/67
6,901,226 B2 * 5/2005 Claassen ..... 399/67

FOREIGN PATENT DOCUMENTS

JP 09-274407 * 10/1997

* cited by examiner

*Primary Examiner*—Sandra L. Brase
(74) *Attorney, Agent, or Firm*—Finnegan, Henderson, Farabow, Garrett & Dunner, L.L.P.

(57) ABSTRACT

An image forming apparatus is disclosed having a fixing unit having a heating device, for heat fixing, a heating power supply section which is connected to the fixing unit to supply electric power supplied from a commercial power supply to the heating device, a voltage detecting section for detecting a value of voltage supplied to the heating power supply section from the commercial power supply, and a control section that stops a supply of electric power to the heating device from the heating power supply section if a first voltage value is smaller than a standard voltage value, while, compares a second voltage value detected by the voltage detecting section after the lapse of the standard time with the standard voltage value, and conducts control to stop operations for image forming if the second voltage value is smaller than the standard voltage value.

39 Claims, 11 Drawing Sheets

INFORMATION FORMING APPARATUS EQUIPPED WITH A FIXING UNIT

BACKGROUND OF THE INVENTION

1. Field of the Invention

The present invention relates to an image forming apparatus equipped with a fixing unit.

2. Description of Related Art

With respect to an input voltage value for a power supply device which is provided in an apparatus and supplies electric power supplied from a commercial power supply to each load in the apparatus, there is frequently caused a voltage drop, depending on a line impedance of commercial power supply, the state of installation of the apparatus and the state of power distribution. When the input voltage value for the power supply device goes down to be lower than the power supply operating limit voltage value, it sometimes happens that the power supply device not only fails to supply the prescribed power to the loads in the apparatus but also stops or goes wrong.

The image forming apparatus equipped with a fixing unit is provided with a heating power supply section for the purpose of supplying electric power to a heating means such as an induction coil or a halogen heater. The heating power supply section is required to provide higher output compared with other power supply devices, and is of the structure wherein the operating limit input voltage value is high, because a load for supplying electric power is a heat source.

Therefore, when an instantaneous stop or a voltage drop takes place for electric power supplied from a commercial power supply, the voltage value of electric power supplied from the commercial power supply becomes equal to or lower than the operating limit voltage value earlier than other power supply devices, and the heating power supply section turns out to be unable to supply electric power to the heating means. Accordingly, in the image forming apparatus, electric power is not supplied to the heating means from the heating power supply section, and thereby, a heat roller is not heated, the fixing temperature is lowered to cause fixing failures, which makes it impossible to obtain desired images.

Therefore, there have been an electrical apparatus to activate a protection circuit when input voltage coming from a commercial power supply is lowered, or when it is equal to or lower than the prescribed voltage value, and an image forming apparatus to activate a breaking means (relay) for electric power supply in abnormal temperatures of a fixing unit employing a halogen heater or a film heating system.

As a method to solve the problems stated above, there has been disclosed an electrical apparatus wherein a driving means is driven to activate a protection circuit when a power supply is not higher than the prescribed voltage value in the course of a standstill (standing by) of the driving means, and a printing operations is stopped when a power supply is lower than the prescribed voltage in the course of printing (for example, TOKKAI No. 2000-29579).

Further, there is disclosed an image forming apparatus (for example, TOKKAI No. 2003-57991) having therein an input breaking relay that breaks electric power supply to a heating means of a fixing unit having therein a heating means, a switching means that controls electric power supply to the heating means and a relay abnormality detecting means that detects abnormality of an input breaking relay based on signals coming from an input voltage means which detects voltage of the input breaking relay, wherein the switching means is driven based on output of detection by the relay abnormality detecting means.

However, TOKKAI No. 2000-29579 represents a method for stopping electric power supply for preventing troubles in the power supply device in the case of low voltage, and it is inconvenient in use, because printing operations are stopped immediately when voltage becomes lower than the prescribed voltage value in the course of printing. Further, TOKKAI No. 2003-57991 represents a method for preventing malfunctions of a relay circuit that breaks electric power supply and for preventing excessively high temperature of a heating roller by making the relay to be on and off properly when a fixing unit is in abnormality. In TOKKAI No. 2003-57991, therefore, the main body control section and a user are not conscious of a fear that the heating power supply section cannot supply sufficient electric power to the heating means because of low voltage abnormality to cause fixing failures.

In the fixing unit of an induction heating system, when electric power supply from the heating power supply section is stopped, electric power supplied to the induction coil is stopped, and therefore, an induction magnetic field for heating a heating roller cannot be generated and a temperature of the heating power supply section is lowered to cause fixing failures. Further, when input electric power of the heating power supply section is lowered, the electric power control to be supplied to the induction coil cannot supply high frequency electric current for generating the induction magnetic field for heating the heating roller, resulting in a fear that not only fixing failures but also malfunctions and a runaway of a circuit for driving the induction coil are caused.

When the aforesaid problems are caused, the main body control section of the image forming apparatus only judges that the heating power supply section is stopped and a temperature of the fixing unit is lowered, thus, there is a fear that electric power to the heating means is topped to cause temperature drop of the heating roller (fixing temperature drop) and to cause fixing failures.

The invention has been achieved, in view of the problems stated above. Namely, an object of the invention is to provide an image forming apparatus equipped with a fixing unit wherein an occurrence of fixing failures can be controlled in the case of input electric power abnormality of a heating power supply section. Further, another object is to provide an image forming apparatus wherein malfunctions of a fixing unit can be controlled when input electric power for a heating power supply section is abnormal, and it is convenient to use.

SUMMARY OF THE INVENTION

The invention is represented by an image forming apparatus having therein a fixing unit having a heating device, for heat fixing; a heating power supply section which is connected to said fixing unit to supply electric power supplied from a commercial power supply to said heating device; a voltage detecting section for detecting a value of voltage supplied to the heating power supply section from said commercial power supply; a time measuring section for measuring predetermined standard time when the first voltage value detected by said voltage detecting section is judged to be smaller than a predetermined standard voltage value; and a control section that compares the first voltage value with the standard voltage value, and stops a supply of electric power to the heating device from the heating power supply section if the first voltage value is smaller than the standard voltage value, while, compares the second voltage value detected by the voltage detecting section after the lapse of the standard time with the standard voltage value, and conducts control to stop operations for image forming if the second voltage value is smaller than the standard voltage value.

Figure 1:
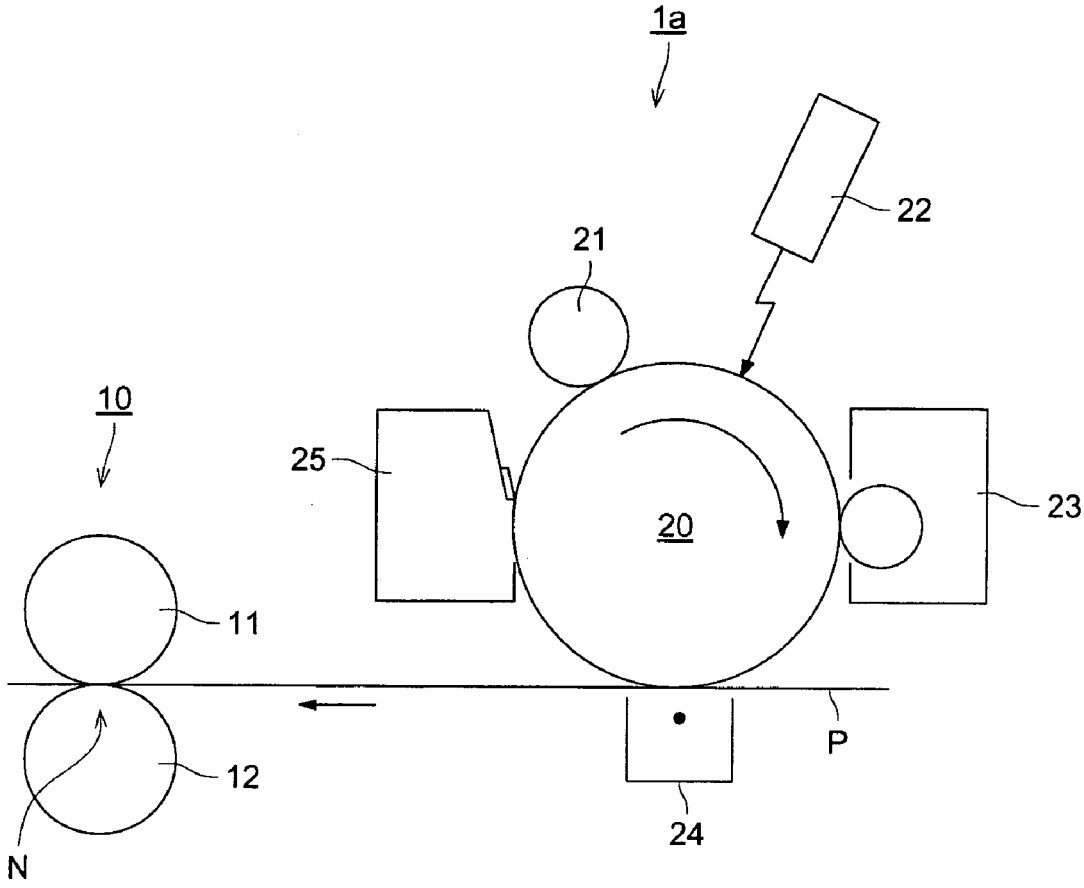
FIG. 1 is a schematic structure diagram of image forming apparatus 1*a* in the present embodiment 1.

DETAILED DESCRIPTION OF THE PREFERRED EMBODIMENTS (Embodiment 1)

Embodiment 1 of the invention will be explained in detail as follows, referring to the drawings.

FIG. 1 shows a schematic structure diagram of image forming apparatus 1*a* in the present embodiment 1.

As shown in FIG. 1, photoreceptor drum 20 is provided on the image forming apparatus 1*a*, and a surface of the photoreceptor drum 20 is charged by charging unit 21 at prescribed voltage, then, the surface of the photoreceptor drum 20 is exposed to an image by exposure means 22 to form thereon an electrostatic latent image which is then developed by developing unit 23 by the use of developing agents to be visualized as a toner image, and the toner image thus obtained is transferred onto recording material P such as a sheet of paper conveyed to the photoreceptor drum 20 by transfer means 24. The photoreceptor drum 20 from which the toner image has been transferred is cleaned by cleaner 25 which removes toner remaining on the surface of the photoreceptor drum 20 after the aforementioned transferring. Thus, the photoreceptor drum 20 is ready for the following image forming.

On the other hand, the recording material P carrying the toner image is conveyed from the photoreceptor drum 20 to induction heating fixing unit 10 that serves as a fixing unit. In the induction heating fixing unit 10, a non-fixed toner image on the recording material P is fixed, thus, a print image is obtained on the recording material P.

The induction heating fixing unit 10 is composed of heating roller 11, pressure roller 12 that comes in pressure contact with the heating roller 11 and thereby forms nip portion N and induction coil 13 that serves as a heating means provided in the heating roller 11. The toner image on the recording material P is fixed when it passes through the nip N where the heating roller 11 and the pressure roller 12 are in pressure contact with each other.

Figure 2:
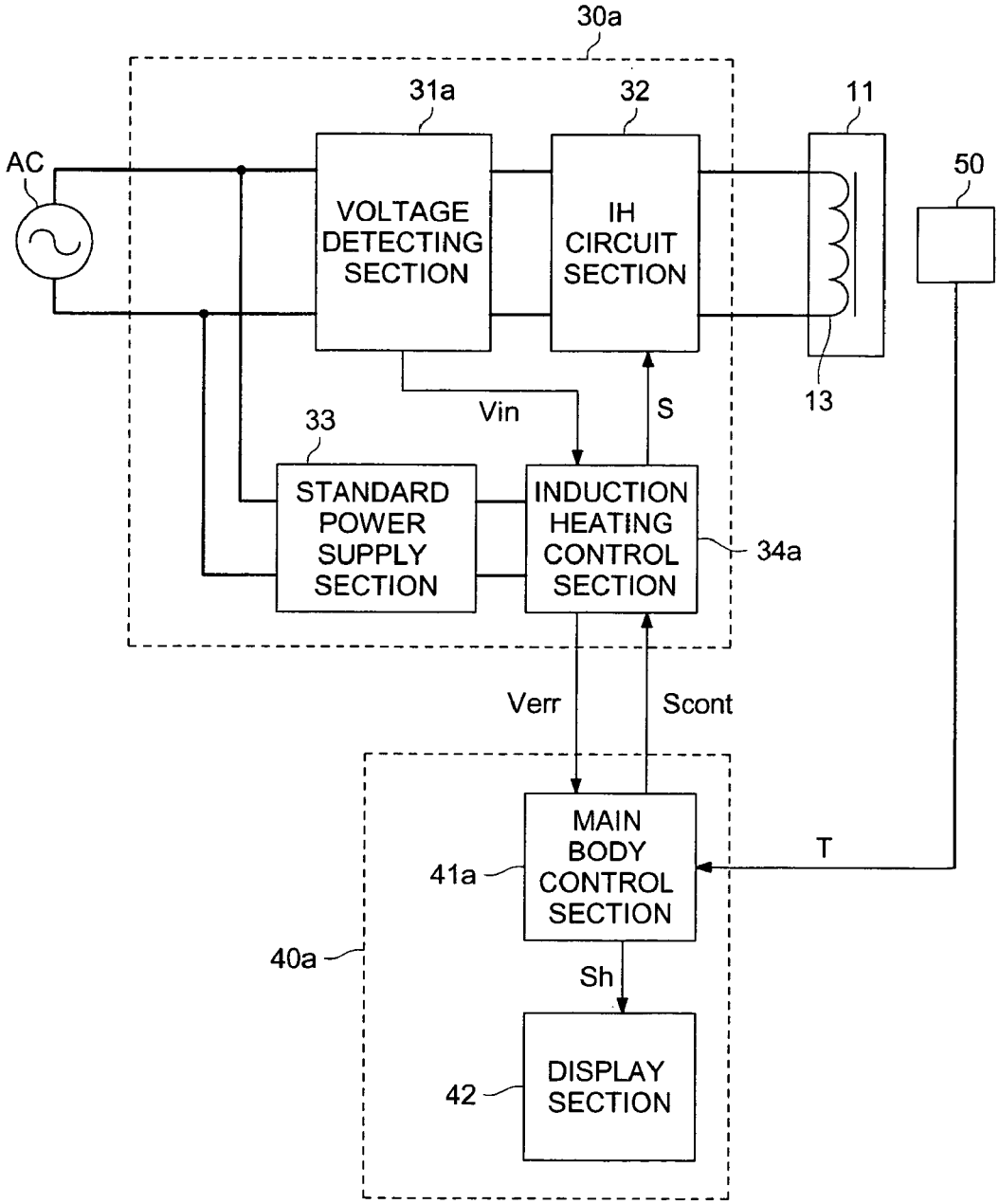
FIG. 2 is a block diagram of a primary control structure of induction heating fixing unit 10 in the present embodiment 1.

FIG. 2 shows a block diagram of a primary control structure for the induction heating fixing unit 10 in the present embodiment 1.

As shown in FIG. 2, the primary control structure of the induction heating fixing unit 10 comprises induction heating fixing unit 10 that is further composed of induction coil 13, heating roller 11 and pressure roller 12 shown in FIG. 1, induction heating power supply section 30*a* serving as a heating power supply section such as voltage detecting section 31*a* serving as a voltage detecting means, IH (Induction Heating) circuit section 32, standard power supply section 33 and induction heating control section 34*a* serving as a control means, temperature detecting section 50 serving as a means to detect a temperature of heating roller 11, namely, to detect a temperature of induction heating fixing unit 10, and main body unit 40*a* including main body control section 41*a* serving as a control means that conducts control of energizing to induction coil 13 and display section 42 serving as a notifying means.

The voltage detecting section 31*a* detects input voltage value of electric power inputted to the induction heating power supply section 30*a* from commercial power supply AC. Detected voltage value Vin thus detected is outputted to the induction heating control section 34*a*.

The IH circuit section 32 has therein a capacitor connected with induction coil 13 to be in parallel therewith so that AC current with a fixed frequency may be supplied to induction coil 13, a switching element for turning on and turning off of electric power supplied to induction coil 13 and a gate driver circuit for operating the switching element (not shown). The IH circuit section 32 is a circuit that converts the inputted electric power into AC current for generating induction magnetic field on induction coil 13 and conducts a supply of driving current to induction coil 13 when the gate driver circuit operates the switching element based on control signal S for energizing inputted from the induction heating control section 34*a*.

The standard power supply section 33 is a power supply for driving the induction heating control section 34*a*. The standard power supply section 33 branches electric power inputted to induction heating power supply section 30*a* from commercial power supply AC, and supplies electric power to the induction heating control section 34*a*.

The induction heating control section 34*a* receives a supply of electric power from the standard power supply section 33 and controls the induction heating power supply section 30*a* entirely. When instruction signal Scont for energizing is inputted from main body control section 41*a*, the induction heating control section 34*a* outputs the control signal S for energizing to the IH circuit section 32 based on the instruction signal Scont for energizing, and drives the IH circuit section 32. The control signal S for energizing is a signal to operate the IH circuit section 32 to conduct a supply or stopping the supply for electric power to the induction coil 13.

When the voltage inputted from commercial power supply AC is lowered, the IH circuit section 32 cannot supply electric power properly to induction coil 13. In addition, since a value of the voltage inputted from commercial power supply AC is small, a value of electric current is increased, and there is a possibility that the IH circuit section 32 is damaged. Therefore, in the present embodiment 1, the induction heating control section 34*a* compares detected voltage value Vin inputted from the voltage detecting section 31*a* with standard voltage value V0 established in advance, and outputs low voltage error signal Verr that shows low voltage abnormality to the main body control section 41*a*, when the detected voltage value Vin is smaller than the standard voltage value V0. Further, it cancels the low voltage error signal Verr when the detected voltage value Vin is equal to or more than the standard voltage value V0.

A preferable value of establishment for the standard voltage value V0 that is established for the induction heating control section 34*a* in advance will be explained. Because of line impedance of commercial power supply AC and of how image forming apparatus 1*a* is installed, the detected voltage value Vin is lowered to about 85% of the rated voltage value relatively frequently.

Many power supply devices are of the construction to be capable of operating even in the case of voltage drop about 80% of the rated voltage value.

Accordingly, with respect to the standard voltage value V0 to be established on the induction heating control section 34*a* in advance, it is preferable, for example, that the standard voltage value can be established within a range of 60%–80% of the rated voltage value, and the standard voltage value V0 is established based on the rated voltage value of induction heating power supply section 30*a* to be used.

Due to this, it is possible to control that the low voltage error signal Verr is frequently outputted, and low voltage abnormality is displayed frequently on display section 42 of the image forming apparatus, and thereby, a user has an illusion that problems are caused frequently, and tends to neglect recognition and taking actions for another problem. In other words, it is possible to output low voltage error signal Verr in the case of operating limit voltage in the induction heating power supply section 30*a*, without being influenced by slight voltage drop caused by line impedance of commercial power supply AC and by the state of installation of image forming apparatus 1*a*.

Further, for other power supply devices, it is also possible to prevent operations under the voltage value which makes it impossible to operate, which is efficient. It is further possible to prevent operations under the low voltage, which leads to low cost.

Main body control section 41*a* controls operations of each portion of image forming apparatus 1*a* on a centralized basis. Further, the main body control section 41*a* outputs energizing instructing signal to the induction heating control section 34*a* based on detected temperature T coming from temperature detecting section 50, and controls energizing to induction coil 13 (namely, control of temperature of heating roller 11). The energizing instructing signal is a signal to instruct a supply or stopping the supply for electric power to the induction coil 13.

In the present embodiment 1, when the low voltage error signal Verr is inputted from the induction heating control section 34*a*, the main body control section 41*a* recognizes that the induction heating power supply section 30*a* is in low voltage abnormality, and outputs, to display section 42, the display signal Sh for notifying low voltage abnormality and fixing heating stop to a user, and controls display signal Sh to cancel it, after inputting of low voltage error signal Verr is stopped.

Further, the main body control section 41*a* conducts measurement of time for standard time t0 by the timer serving as a time measuring means in the main body control section 41*a*, when the low voltage error signal Verr is inputted. Incidentally, measuring time by a timer may either be conducted by the induction heating control section 34*a* or be conducted by both the main body control section 41*a* and the induction heating control section 34*a*.

The main body control section 41*a* turns off the energizing instructing signal so that supply of electric power to induction coil 13 from IH circuit section 32 may be stopped. Further, the main body control section 41*a* judges whether detected temperature T coming from temperature detecting section 50 is smaller than standard temperature T0 or not, when low voltage error signal Verr inputted from the induction heating control section 34*a* is not canceled after the lapse of standard time t0, and when the detected temperature T is smaller than the standard temperature T0, the main body control section 41*a* controls each portion of image forming apparatus 1*a* to stop the operation for image forming, and controls display section 42 to display that image forming is impossible.

Since causes of occurrence of an instantaneous stop and a voltage drop are mostly natural phenomena including a thunderbolt on a power line, it is difficult to avoid them. Since a period of time for the power failure is determined by the operation time of a protective relay and a circuit breaker, it is preferable to set the standard time t0 to 20 msec–5 sec, for example, based on the standard (for example, IEC/EN61000-4-11) established by the International Electrotechnical Commission (IEC).

Though the display section 42 is provided with a liquid crystal display such as LCD (Liquid Crystal Display), CRT (Cathode Ray Tube) display, PDP (Plasma Display Panel) or EL (Electro Luminescence) can also be used, provided that imagery display of various display data can be carried out in accordance with display signal Sh inputted from the main body control section 41*a* and various instruction signals.

Temperature detecting section 50 is installed on the outer circumference side of heating roller 11 on a non-contact basis or on a contact basis. As the temperature detecting section 50, it is possible to use temperature sensors such as a thermistor, a thermocouple and an infrared sensor, for example, to which, however, the invention is not limited, and those which can detect temperatures of heating roller 11 or temperatures in the vicinity of the heating roller 11 can also be used.

Incidentally, the induction heating control section 34*a* may either be a control section peculiar to induction heating fixing unit 10 included in the induction heating power supply section 30*a*, or be one included in the main body control section 41*a* which is connected to each section in image forming apparatus 1*a* in a way to conduct transmission and reception of various pieces of information mutually, then, receives information from each section, then judges information thus received, and outputs information such as operation instruction representing results of the judgment, to unify each section.

Operations to form images include operations of image forming apparatus 1*a* necessary for image forming such as image forming start processing operations other than image forming operations for forming images on recording material P, and idling operations.

Next, operations of the present embodiment 1 will be explained.

Figure 3:
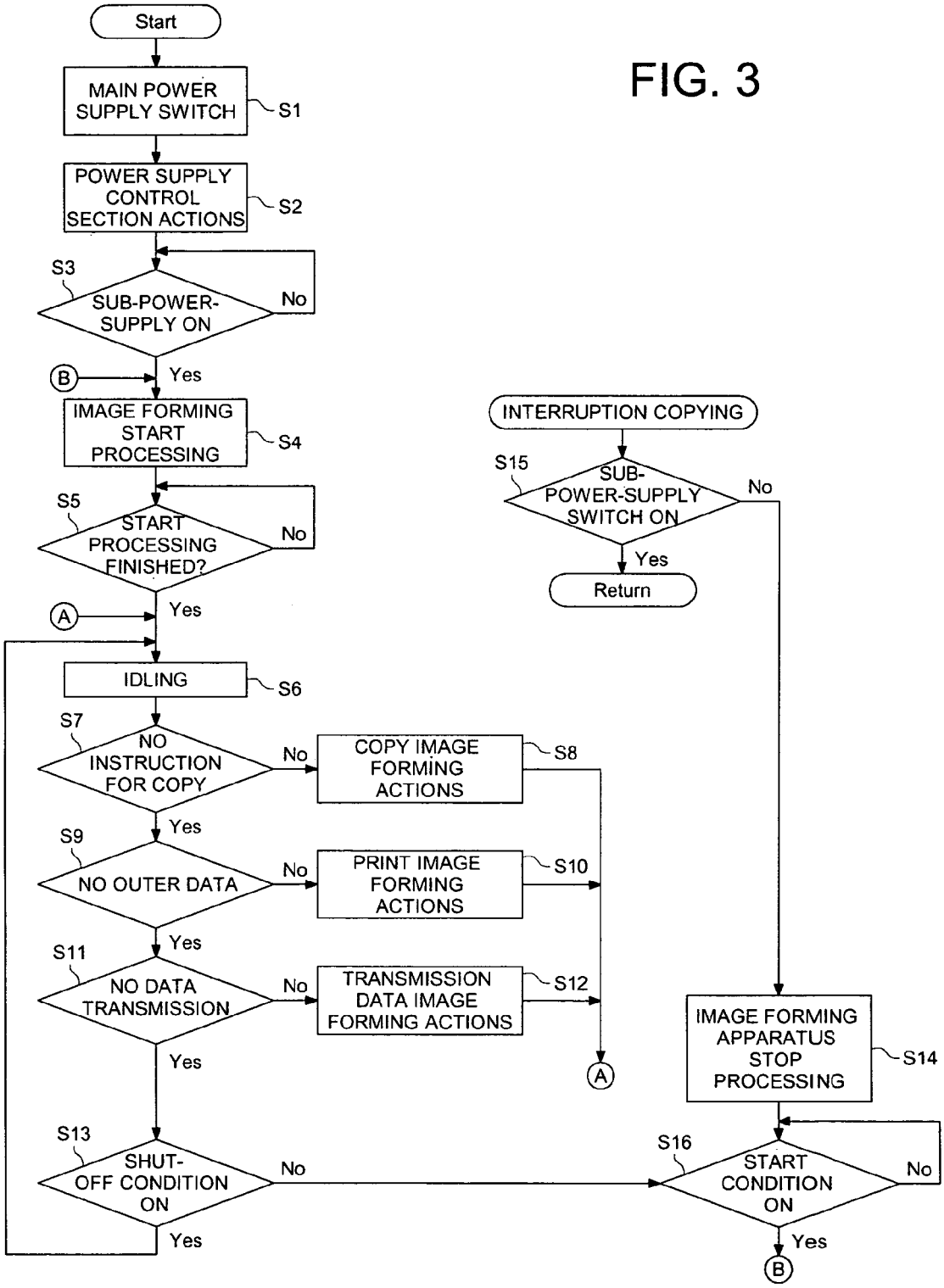
FIG. 3 is a control flow chart of operations covering from turning on of power supply to various image forming actions of image forming apparatus 1*a*.

FIG. 3 shows a control flow chart for operations covering from turning on of power supply for image forming apparatus 1*a* to forming of various images.

When a power supply switch for the image forming apparatus 1*a* is turned on, energizing for a power supply control section (not shown) is started (step S1).

After a main power supply switch is turned on, the power supply control section monitors a sub-power supply switch until a sub-power-supply switch is turned on (step S2).

When a sub-power-supply switch is turned on (step S3; Yes), image forming apparatus 1*a* conducts image forming start processing (step S4).

The image forming start processing means operations wherein heating of heating roller 11 is started by an instruction of the main body control section 41*a* in the induction heating fixing unit 10, for example, and a supply of electric power to induction coil 13 is continued until the heating roller 11 arrives at the prescribed temperature.

Further, in an electric equipment system, there are conducted operations such as initializing of each control section (including CPU, peripheral circuits and memories), initial communication between units and interruption setting. In the mechanism system of image forming apparatus 1*a*, there are conducted operations such as those of home position sensors. In the optical system, there are conducted gain adjustment for a light source such as an illumination lamp for reading a document, and shading processing. In the image writing system, there is conducted adjustment of an amount of light of a light source such as a laser for writing. In the image forming system including photoreceptor drum 20, checking of photoreceptor characteristics (γ characteristics checking and maximum density checking), toner concentration uniformalizing processing by developing unit 23, and cleaning of charging unit 21 and transfer means 24 are conducted.

After completion of start processing (step S5; Yes), the image forming apparatus 1*a* results in the state of idling (step S6). When the image forming apparatus 1*a* is in the state of idling, induction heating fixing unit 10 is heated intermittently so that a prescribed temperature established in advance may be maintained.

After the image forming apparatus 1*a* results in the state of idling, the image forming apparatus 1*a* conducts image forming operations for a copy image (step S8) when there is an instruction for copy (step S7; No). When there are outer data (step S9; No), the image forming apparatus 1*a* conducts image forming operations of print images based on the outer data (step S10). Further, the image forming apparatus 1*a* conducts image forming operations of transmission data (step S12) when there is an instruction for transmitting data to the outside (step S11; No).

The image forming apparatus 1*a* returns to the state of idling (returns to step S6), after image forming operations for copy image (step S8), then, after image forming operations for print image (step S10) and after image forming operations for transmission data (step S12).

Incidentally, though FIG. 3 shows a flow chart of operations of image forming apparatus 1*a* wherein image forming operations of copy image, image forming operations of print image and image forming operations of transmission data are conducted in succession, a plurality of image forming operations may also be conducted simultaneously.

In the image forming apparatus 1*a*, it is judged whether the shutoff condition is turned on or not (step S13), when there is no instruction for copy (step S7; Yes), when there are no outer data (step S9; Yes) and when there is no instruction for transmitting data to the outside (step S11; Yes).

The shutoff condition is a condition for lowering power consumption of image forming apparatus 1*a*. Based on the occasion where an off-mode switch is pressed or the occasion where the suspension is instructed by establishment of weekly timer, the image forming apparatus 1*a* judges that the shutoff condition is turned on. The weekly timer is a timer for setting a range wherein sub-power-supply switch is turned on or turned off based on a day of the week and time.

When the shutoff condition is not turned on (step S13; Yes), the image forming apparatus 1*a* returns to the state of idling (returns to step S6).

When the shutoff condition is turned on (step S13; No), processing for stop the image forming apparatus 1*a* is conducted (step S14).

In the image forming apparatus 1*a*, after commencement of the start processing, establishments of various interruptions are conducted. For example, when interruption to turn off the sub-power-supply switch is established in the course of start processing (step S15; No), processing to stop the image forming apparatus 1*a* is conducted (step S14). When the processing to stop the image forming apparatus 1*a* is conducted, a supply of electric power to the induction heating fixing unit 10 is stopped.

In the image forming apparatus 1*a*, operations to form images are stopped (step S16; No) for the period from completion of processing of stopping (after step S14) up to the moment when start conditions are turned on. Namely, the state of interception of electric power is continued for the induction heating fixing unit 10 until the start conditions are turned on.

The start conditions those under which the electric power needed for operations of the image forming apparatus 1*a* is secured, such as those where an off-mode switch is canceled, or those where the start is commenced by establishment of a weekly timer, or those where the sub-power-switch is turned on.

When the start conditions are turned on (step S16; Yes), the image forming apparatus 1*a* conducts image forming start processing (returns to step S4).

Next, a flow chart for controlling energizing of the induction heating fixing unit 10 in operations for image forming.

Figure 4:
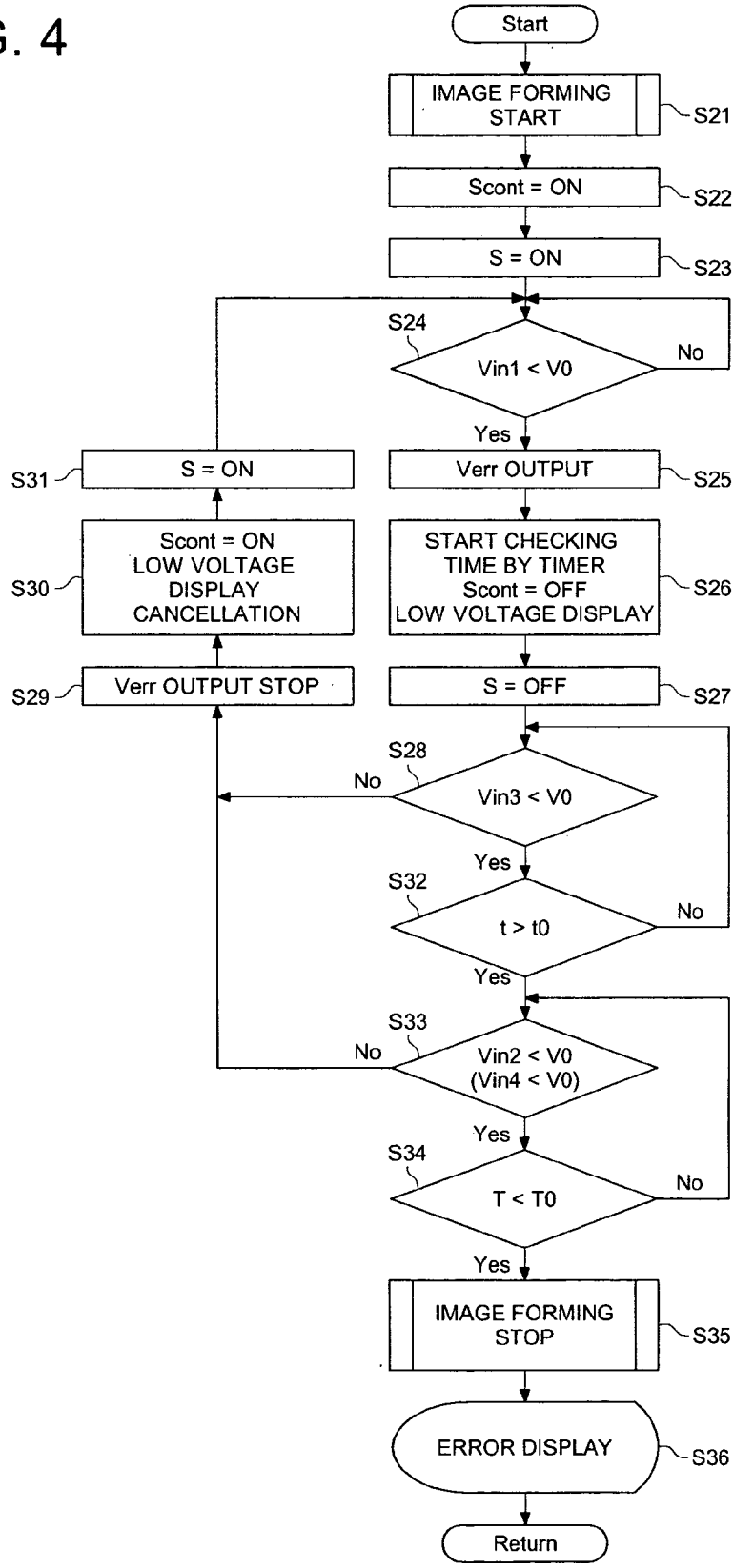
FIG. 4 is a flow chart of control of energizing for induction heating fixing unit 10 in the course of image forming operations in the present embodiment 1.

FIG. 4 shows a flow chart for controlling energizing of the induction heating fixing unit 10 in operations for image forming in the present embodiment 1.

Control of energizing for induction coil 13 in the image forming operations shown in FIG. 4 is conducted in the case of image forming operations for copy image shown in FIG. 3, or in the case of image forming operations for print image, or in the case of image forming operations for transmission data.

When the image forming apparatus 1*a* is in the course of image forming operations, and when electric power is supplied to induction heating power supply section 30*a* from commercial power supply AC (step S21), main body control section 41*a* turns energizing instructing signal Scont on, and outputs the energizing instructing signal Scont to induction heating control section 34*a* (step S22).

When the energizing instructing signal Scont turned on from the main body control section 41*a* is inputted, the induction heating control section 34*a* turns energizing control signal S on, and outputs the energizing control signal S to the IH circuit section 32 (step S23).

When the energizing control signal S which is turned on is inputted, IH circuit section 32 supplies electric power to induction coil 13 to heat heating roller 11. In this case, each section in the image forming apparatus 1*a* conducts image forming operations. In the present embodiment, however, only operations of the induction heating fixing unit 10 will be explained.

After the energizing control signal S is turned on, the induction heating control section 34*a* judges whether first detected voltage value Vin 1 representing the first voltage value inputted from voltage detecting section 31*a* is smaller than standard voltage value V0 or not (step S24).

When the first detected voltage value Vin 1 is smaller than the standard voltage value V0 (step S24; Yes), the induction heating control section 34*a* outputs low voltage error signal Verr to the main body control section 41*a* (step S25).

When the low voltage error signal Verr is inputted from the induction heating control section 34*a*, the main body control section 41*a* turns energizing instructing signal Scont off, and outputs the energizing instructing signal Scont thus turned off to the induction heating control section 34*a*. Further, the main body control section 41*a* starts the time checking of standard time t0 by the timer, and outputs display signal Sh indicating low voltage abnormality to display section 42. After the display signal Sh is inputted from the main body control section 41*a*, the display section 42 displays low voltage abnormality (namely, to stop heating for fixing) (step S26).

When the energizing instructing signal Scont turned off is inputted from the main body control section 41*a*, the induction heating control section 34*a* turns energizing control signal S off, and outputs the energizing control signal S turned off to IH circuit section 32 (step S27). After the energizing control signal S turned off is inputted, the IH circuit section 32 stops a supply of electric power to induction coil 13.

After outputting the energizing control signal S turned off to the IH circuit section 32, the induction heating control section 34*a* judges whether third detected voltage value Vin 3 representing the third voltage value is smaller than standard voltage value V0 or not (step S28).

When the third detected voltage value Vin 3 is judged to be equal to or higher than the standard voltage value V0 (step S28; No), the induction heating control section 34*a* stops outputting of low voltage error signal Verr to the main body control section 41*a* (step S29).

When inputting of the low voltage error signal Verr is stopped, the main body control section 41*a* turns energizing instructing signal Scont on, then, outputs the energizing instructing signal Scont thus turned on to the induction heating control section 34*a* and stops outputting of display signal Sh that shows low voltage abnormality to display section 42. After inputting of the display signal Sh from the main body control section 41*a* is stopped, the display section 42 cancels display of low voltage abnormality (step S30).

When the energizing instructing signal Scont turned on is inputted from the main body control section 41*a*, the induction heating control section 34*a* turns energizing control signal S on, and outputs the energizing control signal S turned on to IH circuit section 32 (step S31). After the energizing control signal S turned on is inputted, the IH circuit section 32 resumes a supply of electric power to induction coil 13. After the supply of electric power to induction coil 13 is resumed, a flow in the flow chart returns to step S24.

When the low voltage error signal Verr inputted from the induction heating control section 34*a* is not canceled within a period of the standard time t0, namely, when the induction heating control section 34*a* judges that the third detected voltage value Vin 3 is smaller than the standard voltage value (step S28; Yes), the main body control section 41*a* judges whether measured time t measured by the timer exceeds the standard time t0 or not (step S32).

When the measured time t is judged not to exceed the standard time t0 (step S32; No), the main body control section 41*a* keeps on monitoring the state of low voltage error signal Verr inputted from the induction heating control section 34*a* until the standard time t0 is measured (returning to step S28).

When the measured time t is judged to exceed the standard time t0 (step S32; Yes), the main body control section 41*a* judges whether the low voltage error signal Verr inputted from the induction heating control section 34*a* is canceled or not. Namely, the induction heating control section 34*a* judges whether second detected voltage value Vin 2 representing the second voltage value detected from voltage detecting section 31*a* is smaller than the standard voltage value V0 established in advance or not (step S33).

When the second detected voltage value Vin 2 is judged to be equal to or more than the standard voltage value V0 by the induction heating control section 34*a* (step S33; No), output of low voltage error signal Verr to the main body control section 41*a* is stopped (step S29).

When inputting of the low voltage error signal Verr is stopped, the main body control section 41*a* turns energizing instructing signal Scont on, then, outputs the energizing instructing signal Scont thus turned on to the induction heating control section 34*a* and stops outputting of display signal Sh that shows low voltage abnormality to display section 42. After inputting of the display signal Sh from the main body control section 41*a* is stopped, the display section 42 cancels display of low voltage abnormality (step S30).

When the energizing instructing signal Scont turned on is inputted from the main body control section 41*a*, the induction heating control section 34*a* turns energizing control signal S on, and outputs the energizing control signal S turned on to IH circuit section 32 (step S31). After the energizing control signal S turned on is inputted, the IH circuit section 32 resumes a supply of electric power to induction coil 13. After the supply of electric power to induction coil 13 is resumed, a flow in the flow chart returns to step S24.

When the second detected voltage value Vin 2 is judged to be smaller than the standard voltage value V0 by the induction heating control section 34*a*, namely, when the low voltage error signal Verr is not canceled (step S33; Yes), the main body control section 41*a* judges whether detected temperature T inputted from temperature detecting section 50 is smaller than standard temperature T0 or not (step S34).

When the detected temperature T is judged to be equal to or more than the standard temperature T0 (step S34; No), the main body control section 41*a* judges whether the low voltage error signal Verr inputted from the induction heating control section 34*a* is canceled or not. Namely, the induction heating control section 34*a* judges whether fourth detected voltage value Vin 4 representing the fourth voltage value detected from voltage detecting section 31*a* is smaller than standard voltage value V0 established in advance or not (returning to step S33).

When the fourth detected voltage value Vin 4 is judged to be equal to or more than the standard voltage value V0 (step S33; No), the induction heating control section 34*a* stops output of the low voltage error signal Verr to the main body control section 41*a* (step S29).

When input of the low voltage error signal Verr is stopped, the main body control section 41*a* turns energizing instructing signal Scont on, then, outputs the energizing instructing signal Scont thus turned on to the induction heating control section 34*a* and stops output of display signal Sh that shows low voltage abnormality to display section 42. If input of display signal Sh from the main body control section 41*a* is stopped, the display section 42 cancels an indication of low voltage abnormality (step S30).

When energizing instructing signal Scont which has been turned on is inputted from the main body control section 41*a*, the induction heating control section 34*a* turns energizing control signal S on, and outputs the energizing control signal S thus turned on to IH circuit section 32 (step S31). After the energizing control signal S thus turned on is inputted, the IH circuit section 32 resumes a supply of electric power to induction coil 13. After the supply of electric power to induction coil 13 is resumed, a flow in the flow chart returns to step S24.

When detected temperature T is judged to be smaller than the standard temperature T0 (step S34; Yes), the main body control section 41*a* controls each section to stop image forming operations, and outputs to display section 42 the display signal Sh which shows that image forming is not allowed (step S35). After display signal Sh is inputted from the main body control section 41*a*, the display section 42 indicates that image forming is not allowed (step S36).

After there is indicated on the display section 42 that image forming is not allowed, a flow in the flow chart returns to processing operations to stop image forming apparatus 1*a* shown in FIG. 3 (step S14).

Incidentally, the present embodiment 1 has been explained in terms of monitoring and control of operations for inputted voltage in the course of image forming operations, which is effective in the state of operations for image forming such as those in the idling to stand by for image forming operations, and those in the image forming start processing for conducting warm-up to heat induction heating fixing unit 10 to the temperature that makes fixing possible.

Figure 5:
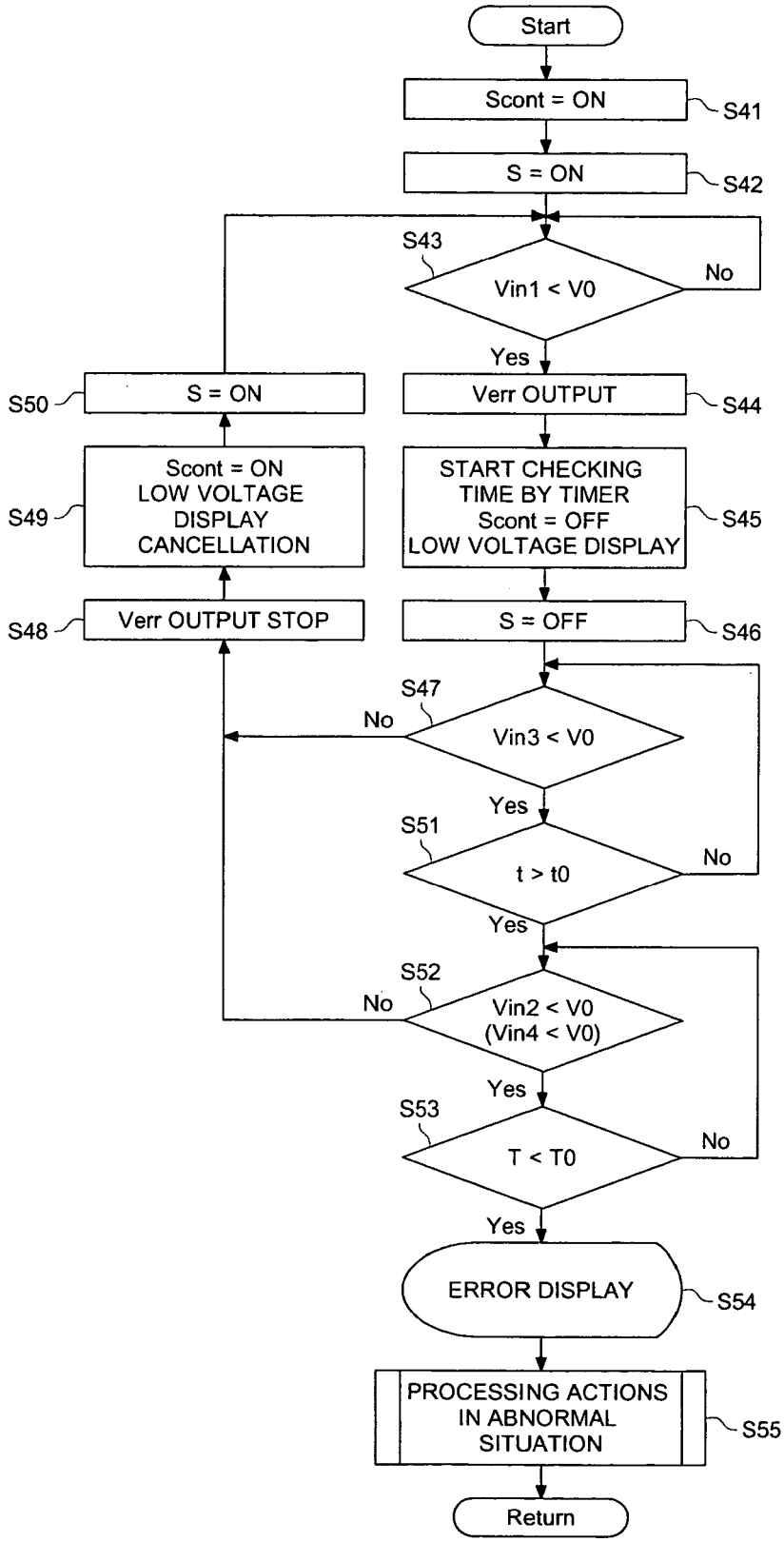
FIG. 5 is a flow chart for control of energizing for induction heating fixing unit 10 in the present embodiment 1.

FIG. 5 is a flow chart for control of energizing for induction heating fixing unit 10 in the course of idling in the present embodiment 1.

Energizing control of the induction heating fixing unit 10 in the course of idling shown in FIG. 5 is an energizing control on the occasion where heating of heating roller 11 is started by an instruction of the main body control section 41*a* in the idling shown in FIG. 3 and a supply of electric power to induction coil 13 is continued until the heating roller 11 arrives at the prescribed temperature.

With respect to step S41–step S55, step S41–step S53 other than step S54 and step S55 are the same as step S22–step S34 in terms of operations, and therefore, detailed explanation for them will be omitted here.

When detected temperature T is judged to be smaller than the standard temperature TO (step S53; Yes), the main body control section 41*a* outputs display signal Sh that shows low voltage abnormality to display section 42.

When display signal Sh is inputted from the main body control section 41*a*, the display section 42 displays low voltage abnormality (step S54).

The main body control section 41*a* conducts abnormality processing operations (step S55) after outputting display signal Sh to display section 42. The abnormality processing operations mean to stop operations of each section of image forming apparatus 1*a* in idling. For example, examples of the abnormality processing operations include stopping of a supply of electric power to the motor that drives a conveyance system for conveying recording material P and stopping of document reading, in addition to stopping of a supply of electric power to induction coil 13.

After abnormality processing operations are completed, a flow in the flow chart returns to operations to stop image forming apparatus 1*a* shown in FIG. 3 (step S14).

Figure 6:
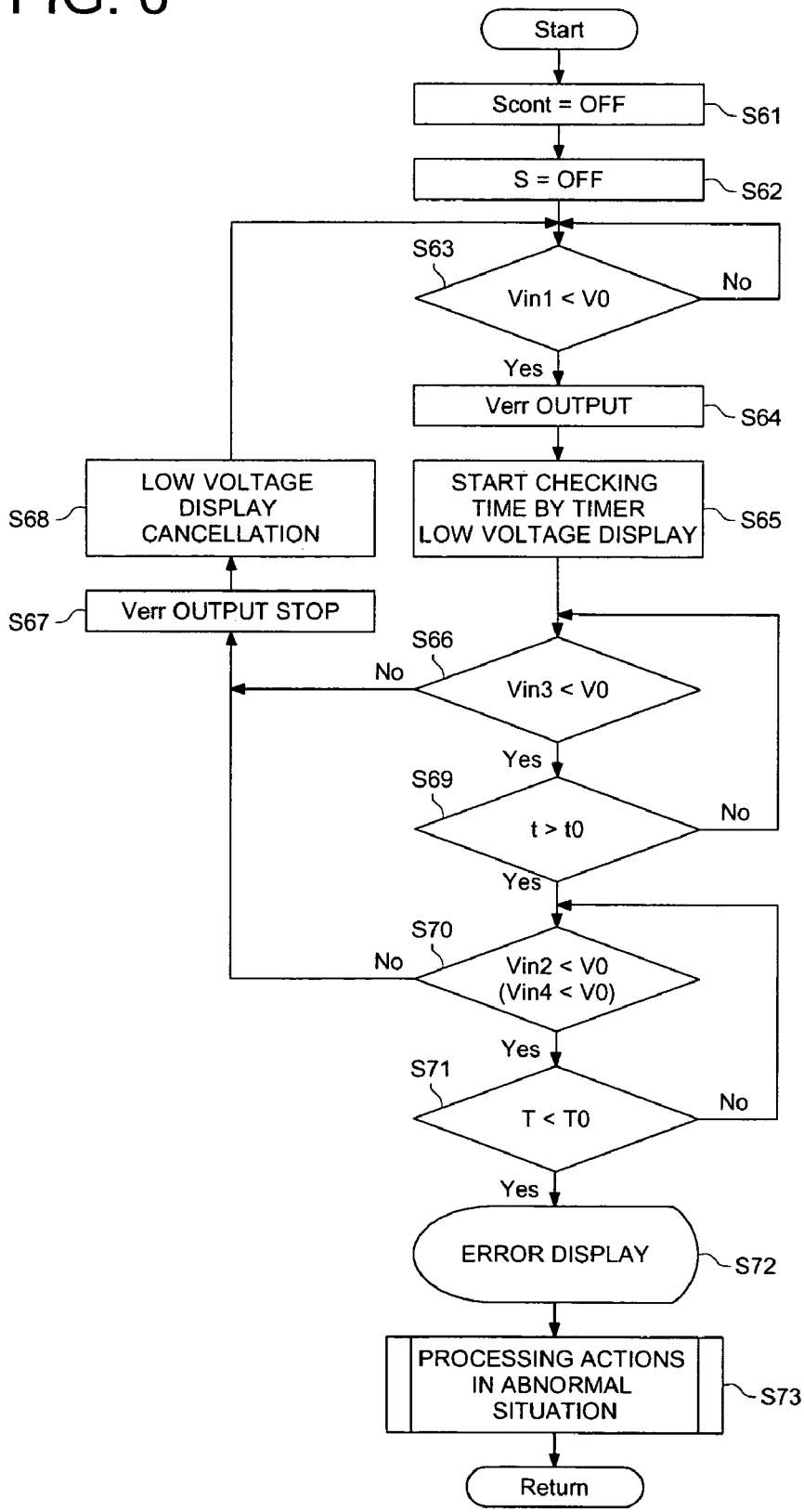
FIG. 6 is a flow chart for another control of energizing for induction heating fixing unit 10 in the course of idling in the present embodiment 1.

FIG. 6 shows a flow chart of another energizing control for induction heating fixing unit 10 in the course of idling in the present embodiment 1.

Energizing control for induction heating fixing unit 10 in the course of idling shown in FIG. 6 is one on the occasion where no electric power is supplied to heating roller 11, because the heating roller 11 has arrived at the prescribed temperature in idling shown in FIG. 3.

Though electric power is supplied from commercial power supply AC to induction heating power supply section 30*a*, the heating roller 11 has arrived at the prescribed temperature, and therefore, the main body control section 41*a* turns energizing instructing signal Scont off, and outputs energizing instructing signal Scont to induction heating control section 34*a* (step S61).

When the energizing instructing signal Scont which has been turned off is inputted from the main body control section 41*a*, the induction heating control section 34*a* turns energizing control signal S off, and outputs the energizing control signal S to IH circuit section 32 (step S62). The IH circuit section 32 stops a supply of electric power to induction coil 13, when the energizing control signal S thus turned off is inputted.

The induction heating control section 34*a* judges (step S63) whether first detected voltage value Vin 1 representing the first voltage value to be inputted from voltage detecting section 31*a* is smaller than the standard voltage value V0 established in advance or not, after turning the energizing control signal S off.

The induction heating control section 34*a* outputs low voltage error signal Verr to the main body control section 41*a* (step S64) when the first detected voltage value Vin 1 is smaller than the standard voltage value V0 (step S63; Yes).

When the low voltage error signal Verr is inputted from the induction heating control section 34*a*, the main body control section 41*a* starts the time measurement of standard time t0 by the timer, and outputs display signal Sh indicating low voltage abnormality to display section 42. After the display signal Sh is inputted from the main body control section 41*a*, the display section 42 indicates low voltage abnormality (namely, low voltage abnormality) (step S65).

The induction heating control section 34*a* judges whether third detected voltage value Vin 3 representing the third voltage value is smaller than the standard voltage value V0 or not (step S66) after outputting low voltage error signal Verr to the main body control section 41*a*.

When the third detected voltage value Vin 3 is judged to be equal to or more than the standard voltage value V0 (step S66; No), the induction heating control section 34*a* stops output of the low voltage error signal Verr to the main body control section 41*a* (step S67).

When input of the low voltage error signal Verr is stopped, the main body control section 41*a* stops output of display signal Sh that shows low voltage abnormality to display section 42. If input of display signal Sh from the main body control section 41*a* is stopped, the display section 42 cancels an indication of low voltage abnormality (step S68). After the indication of low voltage abnormality is canceled, a flow in the flow chart returns to step S63.

When the low voltage error signal Verr inputted from the induction heating control section 34*a* is not canceled within a period of the standard time t0, namely, when the induction heating control section 34*a* judges that the third detected voltage value Vin 3 is smaller than the standard voltage value (step S66; Yes), the main body control section 41*a* judges whether measured time t measured by the timer exceeds the standard time t0 or not (step S69).

When the measured time t is judged not to exceed the standard time t0 (step S69; No), the main body control section 41*a* keeps on monitoring the state of low voltage error signal Verr inputted from the induction heating control section 34*a* until the standard time t0 is measured (returning to step S66).

When the measured time t is judged to exceed the standard time t0 (step S69; Yes), the main body control section 41*a* judges whether the low voltage error signal Verr inputted from the induction heating control section 34*a* is canceled or not. Namely, the induction heating control section 34*a* judges whether second detected voltage value Vin 2 representing the second voltage value to be detected from voltage detecting section 31*a* is smaller than the standard voltage value V0 established in advance or not (step S70).

When the second detected voltage value Vin 2 is judged to be equal to or more than the standard voltage value V0 by the induction heating control section 34*a* (step S70; No), output of low voltage error signal Verr to the main body control section 41*a* is stopped (step S67).

When inputting of the low voltage error signal Verr is stopped, the main body control section 41*a* stops outputting of display signal Sh that shows low voltage abnormality to display section 42. After inputting of the display signal Sh from the main body control section 41*a* is stopped, the display section 42 cancels display of low voltage abnormality (step S68). After the display of the low voltage abnormality is canceled, a flow in the flow chart returns to step S63.

When the second detected voltage value Vin 2 is judged to be smaller than the standard voltage value V0 by the induction heating control section 34*a*, namely, when the low voltage error signal Verr is not canceled (step S70; Yes), the main body control section 41*a* judges whether detected temperature T inputted from temperature detecting section 50 is smaller than standard temperature T0 or not (step S71).

When the detected temperature T is judged to be smaller than the standard temperature T0 (step S71; No), the main body control section 41*a* judges whether the low voltage error signal Verr inputted from the induction heating control section 34*a* is canceled or not. Namely, the induction heating control section 34*a* judges whether fourth detected voltage value Vin 4 representing the fourth voltage value detected from voltage detecting section 31*a* is smaller than standard voltage value V0 established in advance or not (returning to step S70).

When the fourth detected voltage value Vin 4 is judged to be equal to or more than the standard voltage value V0 (step S70; No), the induction heating control section 34*a* stops output of the low voltage error signal Verr to the main body control section 41*a* (step S67).

When input of the low voltage error signal Verr is stopped, the main body control section 41*a* stops output of display signal Sh that shows low voltage abnormality to display section 42. If input of display signal Sh from the main body control section 41*a* is stopped, the display section 42 cancels an indication of low voltage abnormality (step S68). After the display of the low voltage abnormality is canceled, a flow in the flow chart returns to step S63.

When detected temperature T is judged to be smaller than the standard temperature T0 (step S71; Yes), the main body control section 41*a* outputs to display section 42 the display signal Sh which shows low voltage abnormality to the display section 42.

When display signal Sh is inputted from the main body control section 41*a*, the display section 42 displays low voltage abnormality (step S72).

The main body control section 41*a* conducts abnormality processing operations (step S73) after outputting display signal Sh to display section 42.

After abnormality processing operations are completed, a flow in the flow chart returns to operations to stop image forming apparatus 1*a* shown in FIG. 3 (step S14).

Figure 7:
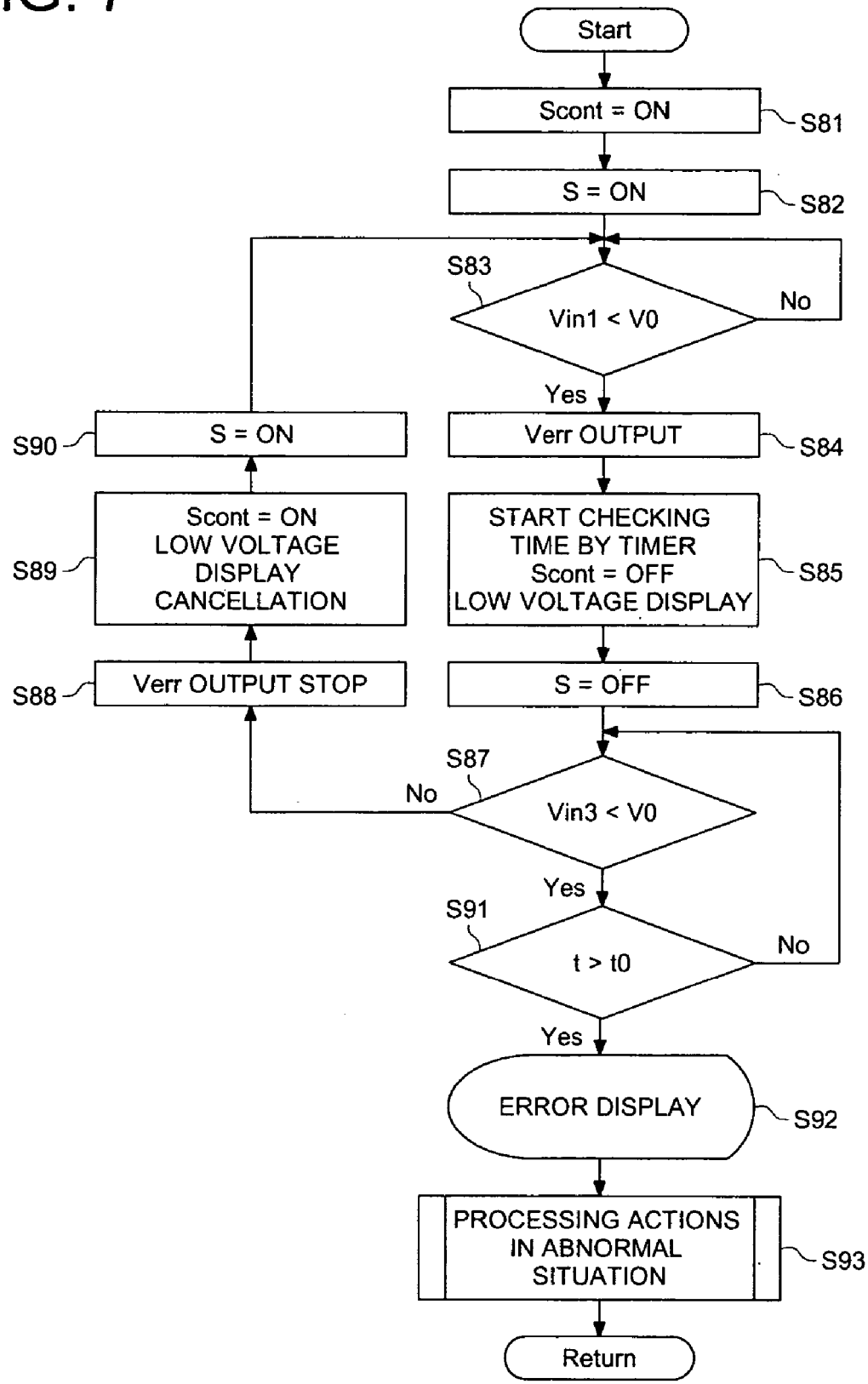
FIG. 7 is a flow chart of energizing control for induction heating fixing unit 10 in the course of start processing for image forming in the present embodiment 1.

FIG. 7 is a flow chart of energizing control for induction heating fixing unit 10 in the course of start processing for image forming in the present embodiment 1.

The energizing control for induction heating fixing unit 10 in the course of start processing for image forming shown in FIG. 7 is energizing control in the occasion wherein there is performed a warm-up for heating the induction heating fixing unit 10 up to the temperature that makes fixing possible under the instruction of the main body control section 41*a* in the start processing for image forming shown in FIG. 3.

When the induction heating fixing unit 10 is in a warming-up process, a temperature of the heating roller 11 is lower than the standard temperature T0. Therefore, the energizing control identical to that in each of step S33 and step S34 shown in FIG. 4 is not conducted.

With respect to step S81–step S93, step S81–step S91 other than step S92 and step S93 are the same as step S22–step S32 in terms of operations, and therefore, detailed explanation for them will be omitted here.

When the measured time t is judged by the induction heating control section 34*a* to exceed the standard time t0 (step S91; Yes), the main body control section 41*a* outputs display signal Sh that shows low voltage abnormality to display section 42.

When display signal Sh is inputted from the main body control section 41*a*, the display section 42 displays low voltage abnormality (step S92).

The main body control section 41*a* conducts abnormality processing operations (step S93) after outputting display signal Sh to the display section 42.

After abnormality processing operations are completed, a flow in the flow chart returns to operations to stop image forming apparatus 1*a* shown in FIG. 3 (step S14).

Incidentally, standard time t0 may also be established separately for each of image forming operations, idling and start processing for image forming.

In the image forming apparatus 1*a* of the present embodiment 1, it is possible to stop a supply of electric power from induction heating power supply section 30*a* to induction coil 13 and to stop operations for image forming, before malfunctions of IH circuit section 32 are caused by a drop of input voltage value of the induction heating power supply section 30*a*. It is therefore possible to restrain malfunctions of the induction heating power supply section 30*a* (IH circuit section 32) and to reduce fixing failures, and thereby, to obtain excellent images. Further, in the image forming apparatus 1*a* of the present embodiment 1, when detected voltage value Vin exceeds the standard voltage value V0 within a period of standard time t0, it is possible to resume a supply of electric power to the induction coil 13 independently of a user, and when detected temperature T is not less than standard temperature T0 and detected voltage value Vin is not less than the standard voltage value V0 within a period of standard time t0, it is possible to resume a supply of electric power to the induction coil 13 independently of a user. Therefore, a user does not need to wait for image forming unnecessarily, which is convenient for the user, and makes it possible to obtain excellent images. It is further possible to stop operations for image forming when judging that occurrences of fixing failures are feared and operations for image forming cannot be conducted properly, thus, usability can be improved.

The image forming apparatus 1*a* of the present embodiment can notify a user of low voltage abnormality (namely, heating for fixing is stopped) by indicating low voltage abnormality on a display section, and can notify a user of impossibility of image forming by indicating that operations for image forming are stopped on a display section, and thereby, improvement of power supply circumstances for the image forming apparatus 1*a* can be urged.

(Embodiment 2)

Embodiment 2 of the invention will be explained in detail as follows, referring to the drawings.

An outline of an image forming apparatus and an example of a control flow chart for power supply introduction for the image forming apparatus and for operations for forming various images are of the same structure as that for Embodiment 1, and an illustration and explanation for them will be omitted.

Figure 8:
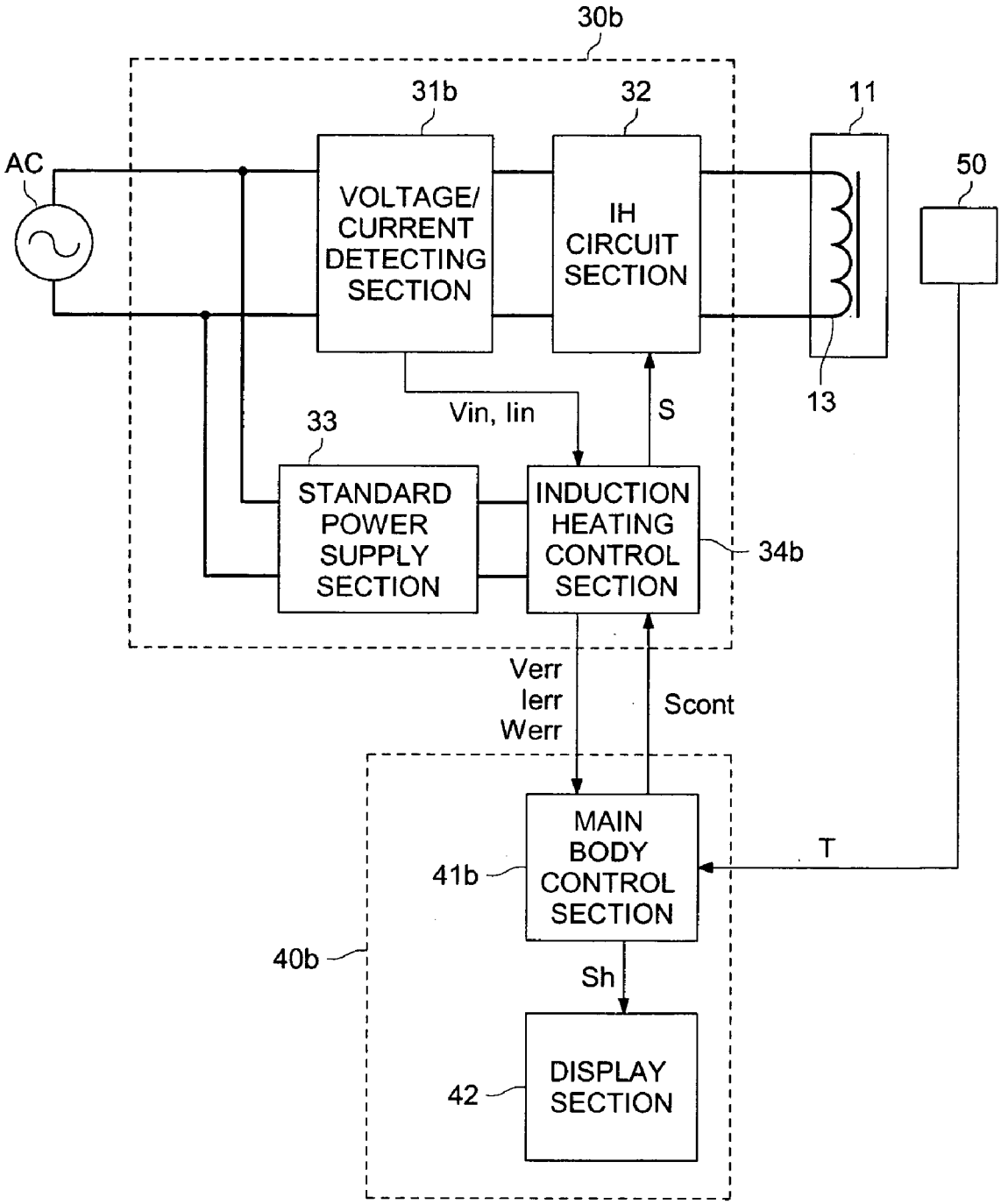
FIG. 8 is a block diagram of a primary control structure of induction heating fixing unit 10 in the present embodiment 2.

FIG. 8 shows a block diagram of a primary control structure of induction heating fixing unit 10 in the present Embodiment 2.

As shown in FIG. 8, the primary control structure of the induction heating fixing unit 10 is composed of the induction heating fixing unit 10 composed of induction coil 13, heating roller 11 and pressure roller 12 shown in FIG. 1, induction heating power supply section 30*b* representing a heating power supply section such as voltage/current detecting section 31*b* representing a voltage detecting means and a current detecting means, IH (Induction Heating) circuit section 32, standard power supply section 33 and induction heating control section 34*b* representing a control means, temperature detecting section 50 representing a means to detect a temperature of heating roller 11, namely, a temperature of the induction heating fixing unit 10, and main body unit 40*b* such as main body control section 41*b* representing a control means conducting energizing control for induction coil 13 and display section 42 representing a notifying means.

Incidentally, since the block diagram of a primary control structure of induction heating fixing unit 10 in the present Embodiment 2 is the same as the block diagram of a primary control structure of induction heating fixing unit 10 in the Embodiment 1, except voltage/current detecting section 31*b*, induction heating control section 34*b* and main body control section 41*b*, the same symbols are given to the same items, and explanation for them will be omitted.

The voltage/current detecting section 31*b* detects an input voltage value and an input current value of electric power inputted in the induction heating power supply section 30*b* from commercial power supply AC. Detected voltage value Vin and detected current value Iin thus detected are outputted to the induction heating control section 34*b*.

The induction heating control section 34*b* receives a supply of electric power from standard power supply section 33, and controls the whole of the induction heating power supply section 30*b*. When energizing instructing signal Scont is inputted from main body control section 41*b*, energizing instructing signal S is outputted to IH circuit section 32 based on the energizing instructing signal Scont to drive the IH circuit section 32. The energizing control signal S is a signal to operate the IH circuit section 32 and to take charge of supply/stop of electric power for induction coil 13.

Now, the IH circuit section 32 cannot supply electric power to induction coil 13 properly, when voltage inputted from commercial power supply AC is low, when a value of inputted electric current is small or when a value of inputted electric current is too large. In the present Embodiment 2, therefore, the induction heating control section 34*b* draws a comparison between detected voltage value Vin inputted from the voltage/current detecting section 31*b* and standard voltage value V0 established in advance, and between detected current value Iin and first standard current value I01 representing the first standard current value established in advance or second standard current value I02 representing the second standard current value, and outputs low voltage error signal Verr showing low voltage abnormality, or current error signal Ierr showing low current abnormality or overcurrent abnormality to the main body control section 41*b*, when the detected voltage value Vin is smaller than the standard voltage value V0, when the detected current value Iin is smaller than the first standard current value I01 or when the detected current value Iin is greater than the second standard current value I02. Further, the induction heating control section 34*b* cancels the low voltage error signal Verr or the current error signal Ierr when the detected voltage value Vin is not less than the standard voltage value V0 and when the detected current value Iin is not less than the first standard current value I01 or the detected current value Iin is not more than the second standard current value I02.

Further, the induction heating control section 34*b* calculates electricity consumption of the induction heating fixing unit 10 based on detected voltage value Vin and detected current value Iin both inputted from the voltage/current detecting section 31*b*, as a means to detect electricity consumption of the induction heating fixing unit 10. The induction heating control section 34*b* compares the calculated electricity consumption W with standard electricity consumption W0 established in advance, and outputs electric power error signal Werr showing low electric power abnormality to main body control section 41*b*, when the electricity consumption W is smaller than the standard electricity consumption W0. The induction heating control section 34*b* cancels the electric power error signal Werr when the electricity consumption W is equal to or more than the standard electricity consumption W0.

Since the standard voltage value V0 established for the induction heating control section 34*b* in advance is the same as that in Embodiment 1, an explanation therefor will be omitted.

The first standard current value I01 and the second standard current value I02 established in advance for the induction heating control section 34*b* can be determined based on tolerance to the induction heating fixing unit 10 and the IH circuit section 32 and on tolerance to standard power supply section 33. The first standard current value I02 is greater than the second standard current value I01.

It is preferable that the first standard current value I01 is a current value that is immediately before the limit at which the IH circuit section 32 cannot supply electric power properly to induction coil 13, and the second standard current value I02 is a current value of the limit at which an outbreak of malfunctions and a runaway of the IH circuit section 32 is not feared.

When the detected current value Iin is smaller than the first standard current value I01, the induction heating fixing unit 10 cannot maintain the temperature which makes fixing possible, resulting in a cause of bringing about fixing failures, and when the detected current value Iin is greater than the second standard current value I02, the IH circuit section 32 causes malfunctions and a runaway, and damage of the IH circuit section 32 and damage of peripheral equipment are feared, resulting in a cause of bringing about fixing failures.

The main body control section 41*b* conducts central control of operations of each section of image forming apparatus 1*a*. Further, the main body control section 41*b* outputs energizing instructing signal Scont to induction heating control section 34*a* based on detected voltage value Vin and detected current value Iin coming from voltage/current detecting section 31*b*, and conducts energizing instruction for induction coil 13 (namely, control of temperature for heating roller 11). Energizing instructing signal Scont is a signal to instruct supply/stop of electric power for induction coil 13.

In the present Embodiment 2, the main body control section 41*b* recognizes that induction heating power supply section 30*b* is in low voltage abnormality, low current abnormality or overcurrent abnormality when low voltage error signal Verr or current error signal Ierr in inputted from induction heating control section 34*b*, and outputs, on display section 42, the display signal Sh that notifies a user of low voltage abnormality, low current abnormality or overcurrent abnormality and fixing heating stop. When input of low voltage error signal Verr and current error signal Ierr is stopped, the main body control section 41*b* controls display signal Sh to be canceled.

Further, the main body control section 41*b* measures standard time t0 by a timer representing a means for time measurement in the main body control section 41*b* when low voltage error signal Verr or current error signal Ierr are inputted. Incidentally, time measurement by a timer may either be conducted on induction heating control section 34*a*, or be conducted on the main body control section 41*a* and the induction heating control section 34*a*.

Further, the main body control section 41*b* turns energizing instructing signal Scont off so that a supply of electric power to induction coil 13 from IH circuit section 32 may be stopped. The main body control section 41*b* further judges whether detected temperature T from temperature detecting section 50 is lower than standard temperature T or not, or whether electric power error signal Werr is inputted or not when low voltage error signal Verr or current error signal Ierr inputted from induction heating control section 34*b* are not canceled after the lapse of standard time t0, and when the detected temperature T is smaller than the standard temperature T0, or when the electric power error signal Werr is inputted, the main body control section 41*b* controls each section of image forming apparatus 1*a* so that operations for image forming may be stopped, and controls so that display section 42 may display that image forming is not allowed.

Since standard time t0 established on the main body control section 41*b* in advance is the same as that in Embodiment 1, an explanation therefor is omitted.

Next, a flow chart of energizing control in operations for image forming will be shown.

Figure 9:
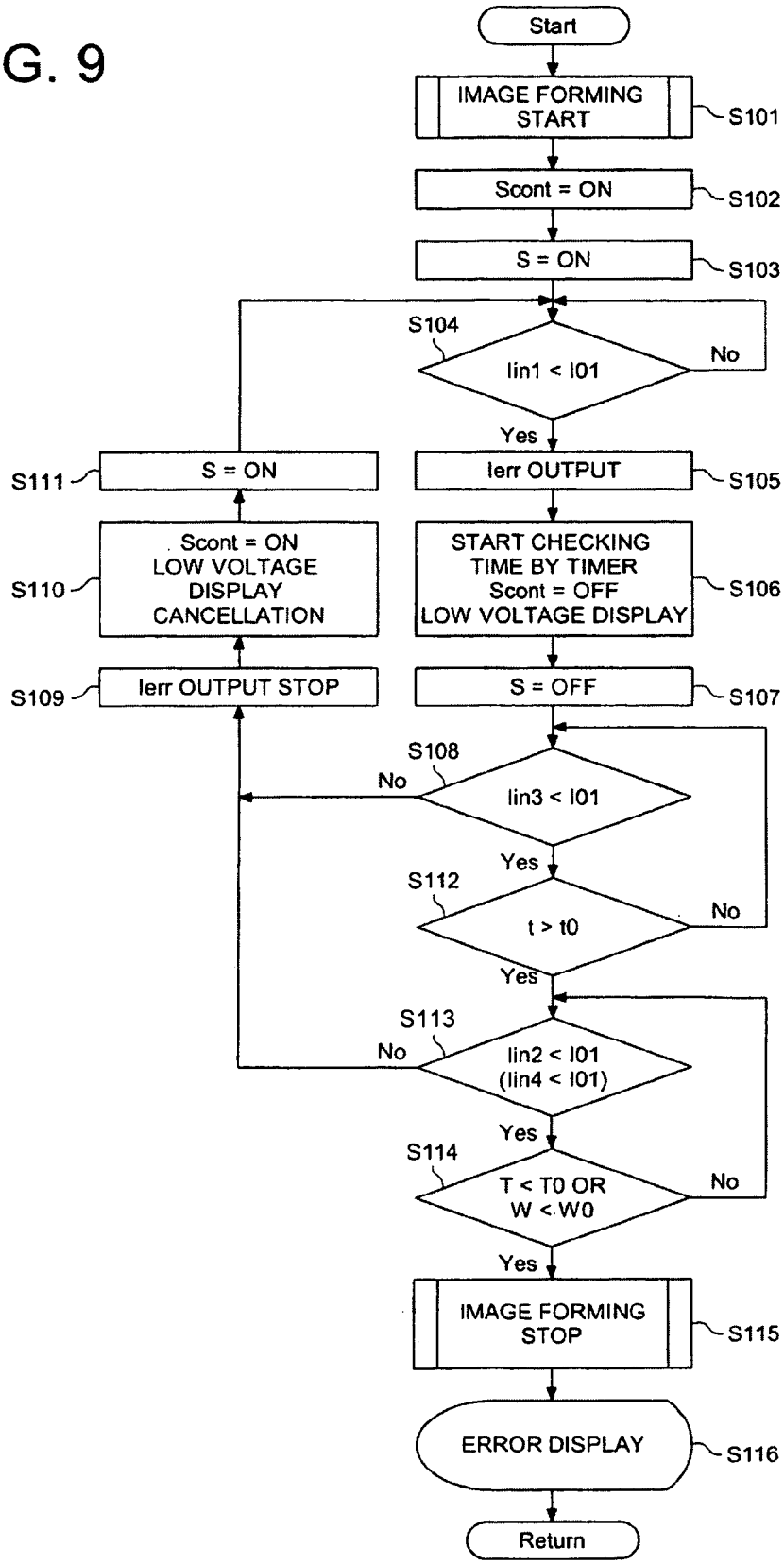
FIG. 9 is a flow chart for control of energizing for induction heating fixing unit 10 in the case of a drop of current value in the course of image forming operations in the present embodiment 2.

FIG. 9 shows a flow chart of energizing control of induction heating fixing unit 10 on the occasion where a current value is lowered in the course of operations for image forming in the present Embodiment 2.

Energizing control of induction coil 13 in the course of operations of image forming shown in FIG. 9 is conducted in the course of image forming operations for copy images shown in FIG. 3, image forming operations for print images and image forming operations for transmission data.

When image forming apparatus 1*a* is in a process of image forming operations, and electric power is being supplied to induction heating power supply section 30*b* from commercial power supply AC (step S101), the main body control section 41*b* turns energizing instructing signal Scont on, and outputs the energizing instructing signal Scont to induction heating control section 34*b* (step S102).

When energizing instructing signal Scont which has been turned on from the main body control section 41*b* is inputted, the induction heating control section 34*b* turns energizing control signal S on, and outputs the energizing control signal S to IH circuit section 32 (step S103).

When the energizing control signal S thus turned on is inputted, the IH circuit section 103 supplies electric power to induction coil 13 to heat heating roller 11. In this case, image forming operations are conducted by respective portions in image forming apparatus 1*a*, and operations of induction heating fixing unit 10 only will be explained in the present embodiment.

After turning the energizing control signal S on, the induction heating control section 34*b* judges whether first detected current value Iin 1 representing the first current value inputted from voltage/current detecting section 31*b* is smaller than the first standard current value I01 established in advance or not (step S104).

When the first detected current value Iin 1 is smaller than the first standard current value I01 (step S104; Yes), the induction heating control section 34*b* outputs current error signal Ierr to the main body control section 41*b* (step S105).

When current error signal Ierr is inputted from the induction heating control section 34*b*, the main body control section 41*b* turns energizing instructing signal Scont off, and outputs the energizing instructing signal Scont thus turned off to the induction heating control section 34*b*. Further, the main body control section 41*b* starts measurement of standard time t0 by the timer, and outputs to display section 42 the display signal Sh that shows low current abnormality. When the display signal Sh is inputted from the main body control section 41*b*, display section 42 displays low current abnormality (namely, stop of fixing heating) (step S106).

When the energizing instructing signal Scont which has been turned off is inputted from the main body control section 41*b*, the induction heating control section 34*b* turns energizing control signal S off, and outputs the energizing control signal S thus turned off to IH circuit section 32 (step S107). The IH circuit section 32 stops a supply of electric power to induction coil 13, when the energizing control signal S thus turned off is inputted.

The induction heating control section 34*b* judges whether third detected voltage value Iin 3 representing the third current value is smaller than the first standard current value I01 or not (step S108), after outputting the energizing control signal S thus turned off to the IH circuit section 32.

When the third detected current value Iin 3 is judged to be equal to or more than the first standard current value I01 (step S108; No), the induction heating control section 34*b* stops output of the current error signal Ierr to the main body control section 41*b* (step S109).

When input of the current error signal Ierr is stopped, the main body control section 41*b* turns energizing instructing signal Scont on, then, outputs the energizing instructing signal Scont thus turned on to the induction heating control section 34*b*, and stops output of display signal Sh that shows low current abnormality to display section 42. The display section 42 cancels the display of low current abnormality (step S110) when input of display signal Sh is stopped from the main body control section 41*b*.

When energizing instructing signal Scont which has been turned on is inputted from the main body control section 41*b*, the induction heating control section 34*b* turns energizing control signal S on, and outputs the energizing control signal S thus turned on to IH circuit section 32 (step S111). The IH circuit section 32 resumes a supply of electric power to induction coil 13 after the energizing control signal S thus turned on is inputted. After a supply of electric power to induction coil 13 is resumed, a flow in the flow chart returns to step S104.

When the low current error signal Ierr inputted from the induction heating control section 34*b* is not canceled within a period of the standard time t0, namely, when the induction heating control section 34*b* judges that the third detected current value Iin 3 is smaller than the first standard current value I01 (step S108; Yes), the main body control section 41*b* judges whether measured time t measured by the timer exceeds the standard time t0 or not (step S112).

When the measured time t is judged not to exceed the standard time t0 (step S112; No), the main body control section 41*b* keeps on monitoring the state of low current error signal Ierr inputted from the induction heating control section 34*b* until the standard time t0 is measured (returning to step S108).

When the measured time t is judged to exceed the standard time t0 (step S112; Yes), the main body control section 41*b* judges whether the current error signal Ierr inputted from the induction heating control section 34*b* is canceled or not. Namely, the induction heating control section 34*b* judges whether second detected current value Iin 2 representing the second current value detected from voltage/current detecting section 31*b* is smaller than the first standard current value I01 established in advance or not (step S113).

When the second detected current value Iin 2 is judged to be equal to or more than the first standard current value I01 by the induction heating control section 34*b* (step S113; No), output of current error signal Ierr to the main body control section 41*b* is stopped (step S109).

When inputting of the current error signal Ierr is stopped, the main body control section 41*b* turns energizing instructing signal Scont on, then, outputs the energizing instructing signal Scont thus turned on to the induction heating control section 34*b* and stops outputting of display signal Sh that shows low current abnormality to display section 42. After inputting of the display signal Sh from the main body control section 41*b* is stopped, the display section 42 cancels display of low current abnormality (step S110).

When the energizing instructing signal Scont turned on is inputted from the main body control section 41*b*, the induction heating control section 34*b* turns energizing control signal S on, and outputs the energizing control signal S thus turned on to IH circuit section 32 (step S111). After the energizing control signal S turned on is inputted, the IH circuit section 32 resumes a supply of electric power to induction coil 13. After the supply of electric power to induction coil 13 is resumed, a flow in the flow chart returns to step S104.

When the second detected current value Iin 2 is judged to be smaller than the first standard current value I01 by the induction heating control section 34*b*, namely, when the low current error signal Ierr is not canceled (step S113; Yes), the main body control section 41*b* judges whether detected temperature T inputted from temperature detecting section 50 is smaller than standard temperature T0 or not, or whether electric power error signal Werr is inputted or not (namely, the induction heating control section 34*b* judges whether the calculated electricity consumption W is smaller than standard electric power W0 and whether electric power error signal Werr is outputted or not) (step S114).

When the detected temperature T is judged to be equal to or more than the standard temperature T0, or when electric power error signal Werr is judged to be inputted (namely, when electricity consumption W is judged to be equal to or more than standard electric power W0 (step S114; No), the main body control section 41*a* judges whether the current error signal Ierr inputted from the induction heating control section 34*b* is canceled or not. Namely, the induction heating control section 34*b* judges whether fourth detected current value Iin 4 representing the fourth current value detected from voltage/current detecting section 31*b* is smaller than the first standard current value I01 established in advance or not (returning to step S113).

When the fourth detected current value Iin 4 is judged to be equal to or more than the standard current value I01 (step S113; No), the induction heating control section 34*b* stops output of current error signal Ierr to the main body control section 41*b* (step S109).

When input of the current error signal Ierr is stopped, the main body control section 41*b* turns energizing instructing signal Scont on, then, outputs the energizing instructing signal Scont thus turned on to the induction heating control section 34*b* and stops output of display signal Sh that shows low current abnormality to display section 42. If input of display signal Sh from the main body control section 41*b* is stopped, the display section 42 cancels an indication of low current abnormality (step S110).

When energizing instructing signal Scont which has been turned on is inputted from the main body control section 41*b*, the induction heating control section 34*b* turns energizing control signal S on, and outputs the energizing control signal S thus turned on to IH circuit section 32 (step S111). After the energizing control signal S thus turned on is inputted, the IH circuit section 32 resumes a supply of electric power to induction coil 13. After the supply of electric power to induction coil 13 is resumed, a flow in the flow chart returns to step S104.

When detected temperature T is judged to be smaller than the standard temperature T0, or when electric power error signal Werr is judged to be inputted (namely, when electricity consumption W is judged to be smaller than standard electric power W0) (step S114; Yes), the main body control section 41*b* controls each section to stop image forming operations, and outputs to display section 42 the display signal Sh which shows to the display section 42 that image forming is not allowed (step S115). After display signal Sh is inputted from the main body control section 41*b*, the display section 42 indicates that image forming is not allowed (step S116).

After there is indicated on the display section 42 that image forming is not allowed, a flow in the flow chart returns to processing operations to stop image forming apparatus 1*a* shown in FIG. 3 (step S14).

As stated above, in the image forming apparatus 1*a* of the present embodiment 2, if the input current value of induction heating power supply section 30*b* drops, it is possible to stop a supply of electric power to induction coil 13 from the induction heating power supply section 30*b* and to stop operations for image forming, before fixing failures take place. It is therefore possible to restrain malfunctions of the induction heating power supply section 30*b* (IH circuit section 32) and to reduce fixing failures, thus, excellent images can be obtained. Further, the image forming apparatus 1*a* of the present embodiment 2 can resume a supply of electric power to induction coil 13 independently of a user when detected current value Iin becomes equal to or more than the first standard current value I01 within a period of standard time t0, and can resume a supply of electric power to induction coil 13 independently of a user when detected temperature T is not less than standard temperature T0 or electricity consumption W is not less than standard output W0 and detected current value Iin is not less than the first standard current value I01. Therefore, a user does not need to wait for image forming unnecessarily, which is convenient for the user, and makes it possible to obtain excellent images. It is further possible to stop operations for image forming when judging that occurrences of fixing failures are feared and operations for image forming cannot be conducted properly, thus, usability can be improved.

The image forming apparatus 1*a* of the present Embodiment 2 can notify a user of low current abnormality by indicating low current abnormality on a display section, and can notify a user of impossibility of image forming by indicating that operations for image forming are stopped on a display section, and thereby, improvement of power supply circumstances for the image forming apparatus 1*a* can be urged.

Figure 10:
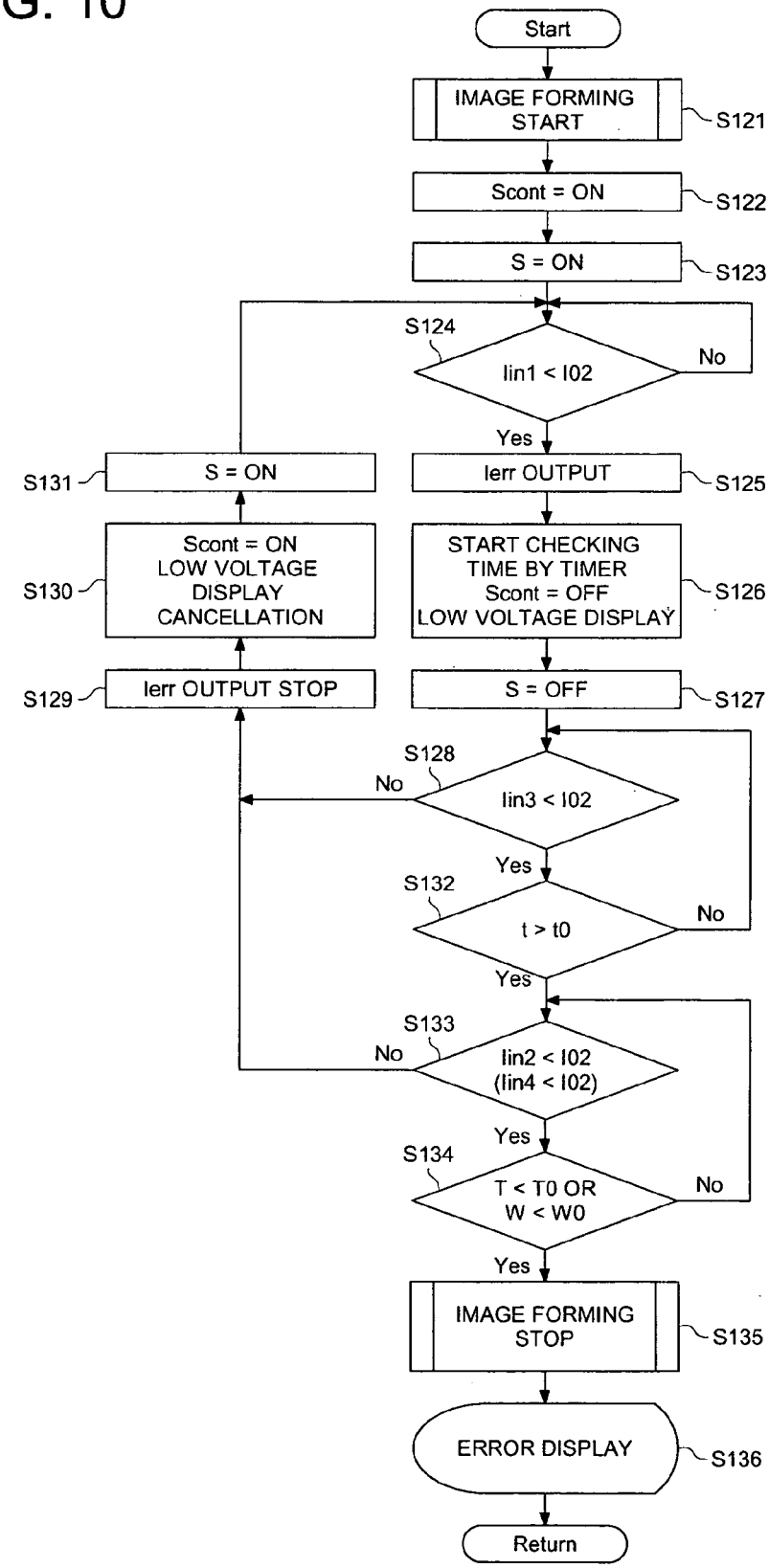
FIG. 10 is a flow chart for control of energizing for induction heating fixing unit 10 in the case of an increase of current value in the course of image forming operations in the present embodiment 2.

FIG. 10 shows a flow chart of energizing control for induction heating fixing unit 10 in the case where a current value is increased in the course of image forming operations in the present Embodiment 2.

Energizing control for induction coil 13 in the course of image forming operations shown in FIG. 10 is carried out in image forming operations for copy images, print images and transmission data all shown in FIG. 3.

Since operations from step S121 to step S136 shown in FIG. 10 are the same as those in FIG. 9, except that the first standard current value I01 shown in FIG. 9 is the second standard current value I02, and the first–fourth detected current values Iin 1–Iin 4 are judged whether they are greater than the second standard current value I02 or not in step S124, step S128 and step S133, the detailed explanations for them are omitted.

As stated above, in the image forming apparatus 1*a* of the present embodiment 2, when a current value is increased by overcurrent caused in the induction heating power supply section 30*b*, it is possible to stop a supply of electric power to induction coil 13 from the induction heating power supply section 30*b* and to stop operations for image forming, before malfunctions and a runaway of IH circuit section 32 take place. It is therefore possible to restrain malfunctions of the induction heating power supply section 30*b* (IH circuit section 32) and to reduce fixing failures, thus, excellent images can be obtained. Further, the image forming apparatus 1*a* of the present embodiment 2 can resume a supply of electric power to induction coil 13 independently of a user when detected current value Iin becomes equal to or lower than the second standard current value I02 within a period of standard time t0, and can resume a supply of electric power to induction coil 13 independently of a user when detected temperature T is not less than standard temperature T0 or electricity consumption W is not less than standard output W0 and detected current value Iin is not more than the second standard current value I02. Therefore, a user does not need to wait for image forming unnecessarily, which is convenient for the user, and makes it possible to obtain excellent images. It is further possible to stop operations for image forming when judging that occurrences of fixing failures are feared and operations for image forming cannot be conducted properly, thus, usability can be improved.

The image forming apparatus 1*a* of the present Embodiment 2 can notify a user of overcurrent abnormality by indicating overcurrent abnormality on a display section, and can notify a user of impossibility of image forming by indicating that operations for image forming are stopped on a display section, and thereby, improvement of power supply circumstances for the image forming apparatus 1*a* can be urged.

Incidentally, though monitoring and control for input current values in the course of image forming operations have been explained, the present Embodiment 2 is effective in the situation of operations for image forming, such as idling for standby for image forming operations and image forming start processing wherein warm-up for heating induction heating fixing unit 10 up to the temperature that makes fixing possible.

Since the flow chart for energizing control of induction heating fixing unit 10 in the case where a voltage value is lowered in the course of image forming operations, in the course of idling and in the course of image forming start processing can be realized by employing Embodiment 1 and a flow chart of energizing control for the induction heating fixing unit 10 based on the detected current value Iin explained in Embodiment 2, explanation for that will be omitted.

(Embodiment 3)

Embodiment 3 of the invention will be explained in detail as follows, referring to the drawings.

In the present Embodiment 3, there will be explained image forming apparatus 1*b* equipped with a fixing unit employing heating resistor 63 as a heating means.

An outline of the image forming apparatus 1*b* and an example of a control flow chart for operations covering from power supply introduction to the image forming apparatus 1*a* up to operations for forming various images are of the same structure as that for Embodiment 1 substantially, and an illustration and explanation for them will be omitted.

Incidentally, though there is explained a fixing unit employing heating resistor 63 as a heating means, in the present Embodiment 3, it is also possible to use a halogen lamp as a heating means.

Figure 11:
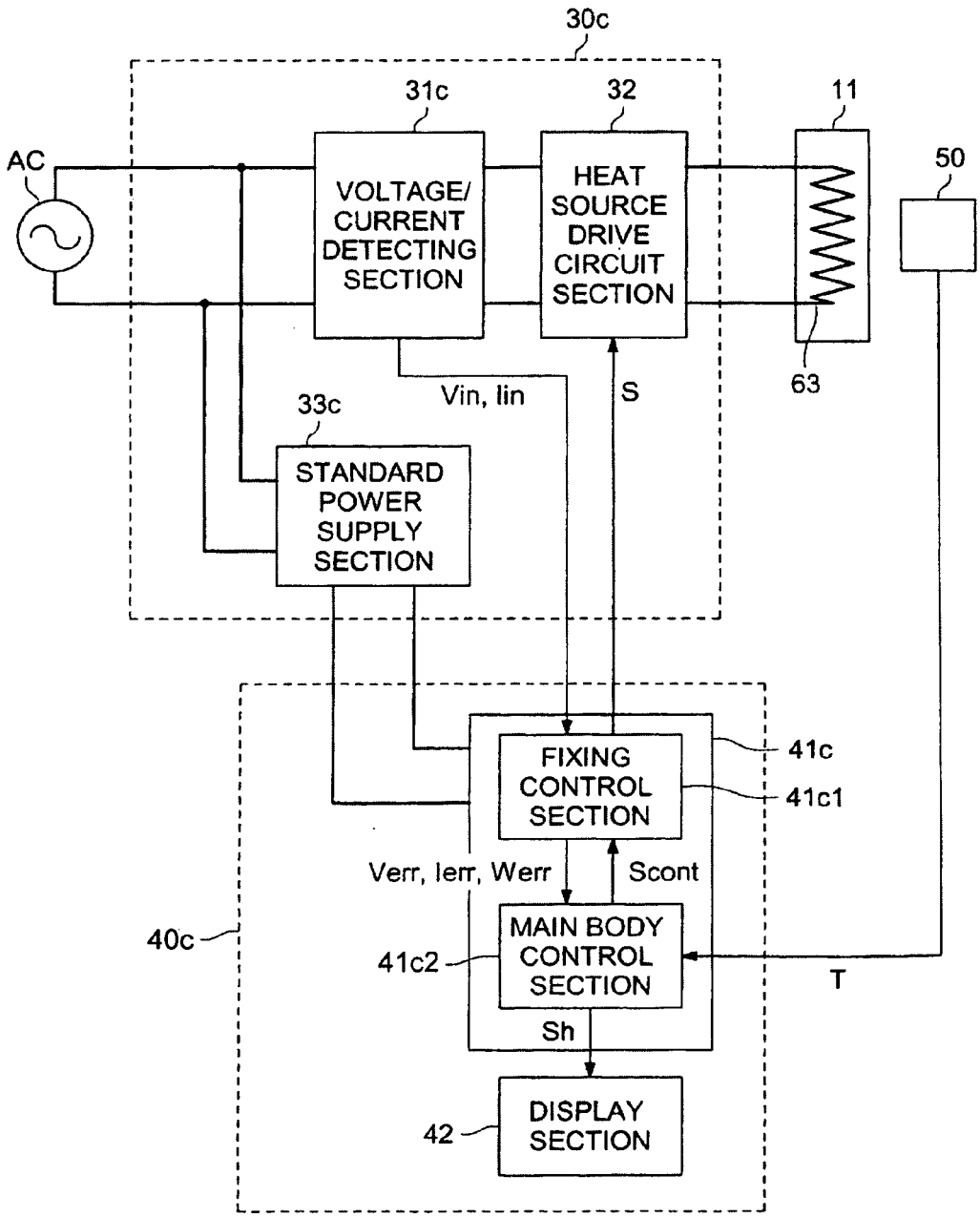
FIG. 11 is a block diagram of a primary control structure of a fixing unit in the present embodiment 3.

FIG. 11 shows a block diagram of a primary control structure of a fixing unit in the present Embodiment 3.

As shown in FIG. 11, the primary control structure of the fixing unit is composed of a fixing unit composed of heating resistor 63, heating roller 11 and pressure roller 12 shown in FIG. 1, heating power supply section 30*c* representing a heating power supply section such as voltage/current detecting section 31*c* representing a voltage detecting means and a current detecting means, IH (Induction Heating) circuit section 32 and standard power supply section, temperature detecting section 50 representing a means to detect a temperature of heating roller 11, namely, a temperature of the fixing unit 10, and main body unit 40*c* such as main body control section 41*c* representing a control means conducting energizing control for the heating resistor 63 and display section 42 representing a notifying means.

Incidentally, since those in the block diagram of a primary control structure of fixing unit 10 in the present Embodiment 3 are the same as those in the block diagram of a primary control structure of induction heating fixing unit 10 in the Embodiment 1, except voltage/current detecting section 31*c*, standard power supply section 33*c* and main body control section 41*c*, the same symbols are given to the same items, and explanation for them will be omitted.

The voltage/current detecting section 31*c* detects an input voltage value and an input current value of electric power inputted in the heating power supply section 30*c* from commercial power supply AC. Detected voltage value Vin and detected current value Iin thus detected are outputted to the main body control section 41*c*.

The standard power supply section 33*c* is a power supply for driving the main body control section 41*c*. The standard power supply section 33*c* branches electric power inputted in induction heating power supply section 30*c* from commercial power supply AC, and supplies electric power to the main body control section 41*c*.

The main body control section 41*c* receives electric power from the standard power supply section 33*c*, and conducts control of the whole of heating power supply section 30*c* and conducts central control of operations of each section of image forming apparatus 1*a*.

The main body control section 41*c* is provided with fixing control section 41*c* 1 and with main control section 41*c*2.

Since the fixing control section 41*c*1 conducts the same operation as that of the induction heating control section 34*b* shown in the Embodiment 2 and the main control section 41*c*2 conducts the same operation as that of the main body control section 41*b* shown in the Embodiment 2, explanation for them will be omitted.

Since operations in the present Embodiment 3 can be realized by quoting operations in Embodiment 2, an illustration and explanation for them will be omitted.

In the embodiments stated above, it is possible to stop operations for image forming before fixing failures take place, which makes it possible to reduce fixing failures and to obtain excellent images.

Further, since it is possible to resume a supply of electric power to a heating means, independently of a user, the user does not need to wait for image forming unnecessarily, which is convenient for the user, and makes it possible to obtain excellent images.

In addition, when the aforementioned embodiments are applied in the case of using an induction heating fixing section having an induction coil and using a heating power supply section that supplies electric power supplied from a commercial power supply, malfunctions of the fixing unit caused by input electric power abnormality can be prevented.

Further, it is possible to stop operations for image forming only when judging that occurrences of fixing failures are feared and operations for image forming cannot be conducted properly, which makes it possible to improve usability.

When judging that occurrences of fixing failures are not feared, and operations for image forming can be conducted properly, a supply of electric power to a heating means can be resumed independently of a user, and only when judging that occurrences of fixing failures are feared, and operations for image forming cannot be conducted properly, operations for image forming can be stopped.

When a value of voltage supplied from a commercial power supply in a heating power supply section results in low voltage abnormality or low current abnormality, a supply of electric power to an induction coil can be stopped, and operations for image forming can be stopped before fixing failure takes place. Therefore, it is possible to restrain malfunctions of a heating power supply section, to reduce fixing failures and to obtain excellent images.

Further, it is possible to stop operations for image forming only when the temperature or electric power is not one that makes fixing possible for an induction heating fixing unit, which makes it possible to improve usability.

Malfunctions of a heating power supply section and a runaway of a circuit both of which are caused when a value of a current supplied to a heating power supply section from a commercial power greater than a standard current value can be prevented, and fixing failures can be restrained, and thereby, excellent images can be obtained.

What is claimed is:

1. An image forming apparatus comprising:

a fixing unit having a heating device, for heat fixing;

a heating power supply section which is connected to the fixing unit to supply electric power supplied from a commercial power supply to the heating device;

a voltage detecting section for detecting a value of voltage supplied to the heating power supply section from the commercial power supply;

a time measuring section for measuring a predetermined standard time when a first voltage value detected by the voltage detecting section is judged to be smaller than a predetermined standard voltage value; and a control section that compares the first voltage value with the standard voltage value, and stops a supply of electric power to the heating device from the heating power supply section if the first voltage value is smaller than the standard voltage value, while, compares a second voltage value detected by the voltage detecting section after the lapse of the standard time with the standard voltage value, and conducts control to stop operations for image forming if the second voltage value is smaller than the standard voltage value.

2. The image forming apparatus of claim 1, wherein the control section compares a third voltage value detected by the voltage detecting section within the standard time with the standard voltage value after judging that the first voltage value is smaller than the standard voltage value, and resumes a supply of electric power to the heating device if judging that the third voltage value is not smaller than the standard voltage value.

3. The image forming apparatus of claim 1, wherein the fixing unit is an induction heating fixing unit having an induction coil, and the heating power supply section supplies electric power supplied from the commercial power supply to the induction coil.

4. The image forming apparatus of claim 1, further comprising:

at least one of a temperature detecting section for detecting temperature of the fixing unit and a electricity consumption detecting section for detecting electricity consumption of the fixing unit, wherein the control section compares the second voltage value detected by the voltage detecting section after the lapse of the standard time with the standard voltage value after judging that the first voltage value is smaller than the standard voltage value, and conducts control to stop operations for image forming if the control section judges that the second voltage value is smaller than the standard voltage value, and judges that the detected temperature is lower than a predetermined standard temperature or that the detected electricity consumption is smaller than a predetermined standard electric power.

5. The image forming apparatus of claim 1, further comprising:

at least one of a temperature detecting section for detecting temperature of the fixing unit and a electricity consumption detecting section for detecting electricity consumption of the fixing unit, wherein the control section resumes a supply of electric power to the heating device if the detected temperature is not lower than a predetermined standard temperature or the detected electricity consumption is not less than a predetermined standard electric power, and if an addtional voltage value detected by the voltage detecting section is not smaller than the standard voltage value, after the lapse of the standard time from the moment of judging that the first voltage value is smaller than the standard voltage value, and conducts control to stop operations for image forming if the detected temperature is lower than the standard temperature or the detected electricity consumption is smaller than the standard electric power.

6. The image forming apparatus of claim 1, further comprising:

a notifying section for notifying low voltage abnormality of the fixing unit when the control section judges that the first voltage value is smaller than the predetermined standard voltage value.

7. The image forming apparatus of claim 1, further comprising:

a notifying section for notifying that operations for image forming will be stopped when the control section conducts control to stop operations for image forming.

8. An image forming apparatus comprising:

an induction heating fixing unit having an induction coil;

a heating power supply section which is connected to the induction heating fixing unit to supply electric power supplied from a commercial power supply to the induction coil;

a voltage detecting section for detecting a value of voltage supplied to the heating power supply section from the commercial power supply; and a control section that compares a first voltage value detected by the voltage detecting section with a predetermined standard voltage value, and conducts control to stop operations for image forming after stopping a supply of electric power to the induction coil from the heating power supply section, if the first voltage value is judged to be smaller than the standard voltage value.

9. The image forming apparatus of claim 8, further comprising:

a notifying section for notifying low voltage abnormality of the induction heating fixing unit when the control section judges that the first voltage value is smaller than the predetermined standard voltage value.

10. The image forming apparatus of claim 8, further comprising:

a notifying section for notifying that operations for image forming will be stopped when the control section conducts control to stop operations for image forming.

11. The image forming apparatus of claim 8, further comprising:

a time measuring section for measuring a predetermined standard time when the first voltage value is judged to be smaller than the standard voltage value, wherein the control section compares a second voltage value detected by the voltage detecting section after the lapse of the standard time with the standard voltage value, after judging that the first voltage value is smaller than the standard voltage value, and conducts control to stop operations for image forming if the second voltage value is judged to be smaller than the standard voltage value, and compares a third voltage value detected by the voltage detecting section within the lapse of the standard time with the standard voltage value, after judging that the first voltage value is smaller than the standard value, and resumes a supply of electric power to the induction coil if the third voltage value is judged to be equal to or more than the standard voltage value.

12. The image forming apparatus of claim 11, further comprising:

at least one of a temperature detecting section for detecting temperature of the induction heating fixing unit and a electricity consumption detecting section for detecting electricity consumption of the induction heating fixing unit, wherein the control section compares the second voltage value detected by the voltage detecting section after the lapse of the standard time with the standard voltage value, after judging that the first voltage value is smaller than the standard value, and conducts control to stop operations for image forming if the second voltage value is judged to be smaller than the standard voltage value and the detected temperature is judged to be smaller than a predetermined standard temperature or the detected electricity consumption is judged to be smaller than a predetermined standard electric power.

13. The image forming apparatus of claim 11, further comprising:

at least one of a temperature detecting section for detecting temperature of the induction heating fixing unit and a electricity consumption detecting section for detecting electricity consumption of the induction heating fixing unit, wherein the control section resumes a supply of electric power to the induction coil if the detected temperature is not less than a predetermined standard temperature or if the detected electricity consumption is not less than a predetermined standard electric power after the lapse of the standard time from the moment when the first voltage value is judged to be smaller than the standard voltage value, and if a fourth voltage value detected by the voltage detecting section is not smaller than the standard voltage value, and conducts control to stop operations for image forming if the detected temperature is smaller than the standard temperature or if the detected electricity consumption is smaller than the standard electric power.

14. An image forming apparatus comprising:

a fixing unit having a heating device, for heat fixing;

a heating power supply section which is connected to the fixing unit to supply electric power supplied from a commercial power supply to the heating device;

a current detecting section for detecting a value of current supplied to the heating power supply section from the commercial power supply;

a time measuring section for measuring a predetermined standard time when a first current value detected by the current detecting section is judged to be smaller than a first predetermined standard current value; and a control section that compares the first current value with the first standard current value, and stops a supply of electric power to the heating device from the heating power supply section if the first current value is smaller than the first standard current value, while, compares a second current value detected by the current detecting section after the lapse of the standard time with the first standard current value, and conducts control to stop operations for image forming if the second current value is smaller than the first standard current value.

15. The image forming apparatus of claim 14, wherein the control section compares a third current value detected by the current detecting section within the standard time with the first standard current value after judging that the first current value is smaller than the first standard current value, and resumes a supply of electric power to the heating device if judging that the third current value is not less than the first standard current value.

16. The image forming apparatus of claim 14, wherein the fixing unit is an induction heating fixing unit having an induction coil, and the heating power supply section supplies electric power supplied from the commercial power supply to the induction coil.

17. The image forming apparatus of claim 14, further comprising:

at least one of a temperature detecting section for detecting temperature of the fixing unit and a electricity consumption detecting section for detecting electricity consumption of the fixing unit, wherein the control section compares the second current value detected by the current detecting section after the lapse of the standard time with the first standard current value after judging that the first current value is smaller than the first standard current value, and conducts control to stop operations for image forming if the control section judges that the second current value is smaller than the first standard current value, and judges that the detected temperature is lower than a predetermined standard temperature or that the detected electricity consumption is smaller than a predetermined standard electric power.

18. The image forming apparatus of claim 14, further comprising:

at least one of a temperature detecting section for detecting temperature of the fixing unit and a electricity consumption detecting section for detecting electricity consumption of the fixing unit, wherein the control section resumes a supply of electric power to the heating device if the detected temperature is not lower than a predetermined standard temperature or the detected electricity consumption is not less than a predetermined standard electric power and if a fourth current value detected by the current detecting section is not smaller than the first standard current value, after the lapse of the standard time from the moment of judging that the first current value is smaller than the first standard current value, and conducts control to stop operations for image forming if the detected temperature is lower than the standard temperature or the detected electricity consumption is smaller than the standard electric power.

19. The image forming apparatus of claim 14, further comprising:

a notifying section for notifying low current abnormality of the fixing unit when the control section judges that the first current value is smaller than the predetermined standard first current value.

20. The image forming apparatus of claim 14, further comprising:

a notifying section for notifying that operations for image forming will be stopped when the control section conducts control to stop operations for image forming.

21. An image forming apparatus comprising:

an induction heating fixing unit having an induction coil;

a heating power supply section which is connected to the induction heating fixing unit to supply electric power supplied from a commercial power supply to the induction coil;

a current detecting section for detecting a value of current supplied to the heating power supply section from the commercial power supply; and a control section that compares a first current value detected by the current detecting section with a first predetermined standard current value, and conducts control to stop operations for image forming after stopping a supply of electric power to the induction coil from the heating power supply section, if the first current value is judged to be smaller than the first standard current value.

22. The image forming apparatus of claim 21, further comprising:

a notifying section for notifying low current abnormality of the induction heating fixing unit when the control section judges that the first current value is smaller than the first predetermined standard current value.

23. The image forming apparatus of claim 21, further comprising:

a notifying section for notifying that operations for image forming will be stopped when the control section conducts control to stop operations for image forming.

24. The image forming apparatus of claim 21, further comprising:

a time measuring section for measuring a predetermined standard time when the first current value is judged to be smaller than the first standard current value, wherein the control section compares a second current value detected by the current detecting section after the lapse of the standard time with the first standard current value, after judging that the first current value is smaller than the first standard current value, and conducts control to stop operations for image forming if the second current value is judged to be smaller than the first standard current value, and compares a third current value detected by the current detecting section within the lapse of the standard time with the first standard current value, after judging that the first current value is smaller than the first standard value, and resumes a supply of electric power to the induction coil if the third current value is judged to be equal to or more than the first standard current value.

25. The image forming apparatus of claim 24, further comprising:

at least one of a temperature detecting section for detecting temperature of the induction heating fixing unit and a electricity consumption detecting section for detecting electricity consumption of the induction heating fixing unit, wherein the control section compares the second current value detected by the current detecting section after the lapse of the standard time with the first standard current value, after judging that the first current value is smaller than the first standard value, and conducts control to stop operations for image forming if the second current value is judged to be smaller than the first standard current value and the detected temperature is judged to be smaller than a predetermined standard temperature or the detected electricity consumption is judged to be smaller than a predetermined standard electric power.

26. The image forming apparatus of claim 24, further comprising:

at least one of a temperature detecting section for detecting temperature of the induction heating fixing unit and a electricity consumption detecting section for detecting electricity consumption of the induction heating fixing unit, wherein the control section resumes a supply of electric power to the induction coil if the detected temperature is not less than a predetermined standard temperature or if the detected electricity consumption is not less than a predetermined standard electric power after the lapse of the standard time from the moment when the first current value is judged to be smaller than the first standard current value, and if a fourth current value detected by the current detecting section is not smaller than the first standard current value, and conducts control to stop operations for image forming if the detected temperature is smaller than the standard temperature or if the detected electricity consumption is smaller than the standard electric power.

27. An image forming apparatus comprising:

a fixing unit having a heating device, for heat fixing;

a heating power supply section which is connected to the fixing unit to supply electric power supplied from a commercial power supply to the heating device;

a current detecting section for detecting a value of current supplied to the heating power supply section from the commercial power supply;

a time measuring section for measuring predetermined standard time when a first current value detected by the current detecting section is judged to be larger than a second predetermined standard current value; and a control section that compares the first current value with the second standard current value, and stops a supply of electric power to the heating device from the heating power supply section if the first current value is larger than the second standard current value, while, compares a second current value detected by the current detecting section after the lapse of the standard time with the second standard current value, and conducts control to stop operations for image forming if the second current value is larger than the second standard current value.

28. The image forming apparatus of claim 27, wherein the control section compares a third current value detected by the current detecting section within the standard time with the second standard current value after judging that the first current value is larger than the second standard current value, and resumes a supply of electric power to the heating device if judging that the third current value is not larger than the second standard current value.

29. The image forming apparatus of claim 27, wherein the fixing unit is an induction heating fixing unit having an induction coil, and the heating power supply section supplies electric power supplied from the commercial power supply to the induction coil.

30. The image forming apparatus of claim 27, further comprising:

at least one of a temperature detecting section for detecting temperature of the fixing unit and a electricity consumption detecting section for detecting electricity consumption of the fixing unit, wherein the control section compares a second current value detected by the current detecting section after the lapse of the standard time with the second standard current value after judging that the first current value is larger than the second standard current value, and conducts control to stop operations for image forming if the control section judges that the second current value is larger than the second standard current value, and judges that the detected temperature is lower than a predetermined standard temperature or that the detected electricity consumption is smaller than a predetermined standard electric power.

31. The image forming apparatus of claim 27, further comprising:

at least one of a temperature detecting section for detecting temperature of the fixing unit and a electricity consumption detecting section for detecting electricity consumption of the fixing unit, wherein the control section resumes a supply of electric power to the heating device if the detected temperature is not lower than a predetermined standard temperature or the detected electricity consumption is not less than a predetermined standard electric power, and if a fourth current value detected by the current detecting section is not larger than the second standard current value, after the lapse of the standard time from the moment of judging that the first current value is larger than the second standard current value, and conducts control to stop operations for image forming if the detected temperature is lower than the standard temperature or the detected electricity consumption is smaller than the standard electric power.

32. The image forming apparatus of claim 27, further comprising:

a notifying section for notifying overcurrent current abnormality of the fixing unit when the control section judges that the first current value is larger than the predetermined standard second current value.

33. The image forming apparatus of claim 27, further comprising:

a notifying section for notifying that operations for image forming will be stopped when the control section conducts control to stop operations for image forming.

34. An image forming apparatus comprising:

an induction heating fixing unit having an induction coil;

a heating power supply section which is connected to the induction heating fixing unit to supply electric power supplied from a commercial power supply to the induction coil;

a current detecting section for detecting a value of current supplied to the heating power supply section from the commercial power supply; and a control section that compares a first current value detected by the current detecting section with a second predetermined standard current value, and conducts control to stop operations for image forming after stopping a supply of electric power to the induction coil from the heating power supply section, if the first current value is judged to be larger than the second standard current value.

35. The image forming apparatus of claim 34, further comprising:

a notifying section for notifying overcurrent abnormality of the induction heating fixing unit when the control section judges that the first current value is greater than the second predetermined standard current value.

36. The image forming apparatus of claim 34, further comprising:

a notifying section for notifying that operations for image forming will be stopped when the control section conducts control to stop operations for image forming.

37. The image forming apparatus of claim 34, further comprising:

a time measuring section for measuring a predetermined standard time when the first current value is judged to be larger than the second standard current value, wherein the control section compares a second current value detected by the current detecting section after the lapse of the standard time with the second standard current value, after judging that the first current value is larger than the second standard value, and conducts control to stop operations for image forming if the second current value is judged to be larger than the second standard current value, and compares a third current value detected by the current detecting section within the lapse of the standard time with the second standard current value, after judging that the first current value is larger than the second standard value, and resumes a supply of electric power to the induction coil if the third current value is judged to be equal to or smaller than the second standard current value.

38. The image forming apparatus of claim 37, further comprising:

at least one of a temperature detecting section for detecting temperature of the induction heating fixing unit and a electricity consumption detecting section for detecting electricity consumption of the induction heating fixing unit, wherein the control section compares the second current value detected by the current detecting section after the lapse of the standard time with the second standard current value, after judging that the first current value is larger than the second standard value, and conducts control to stop operations for image forming if the second current value is judged to be larger than the second standard current value and the detected temperature is judged to be smaller than a predetermined standard temperature or the detected electricity consumption is judged to be smaller than a predetermined standard electric power.

39. The image forming apparatus of claim 37, further comprising:

at least one of a temperature detecting section for detecting temperature of the induction heating fixing unit and a electricity consumption detecting section for detecting electricity consumption of the induction heating fixing unit, wherein the control section resumes a supply of electric power to the induction coil if the detected temperature is not less than a predetermined standard temperature or if the detected electricity consumption is not less than a predetermined standard electric power after the lapse of the standard time from the moment when the first current value is judged to be larger than the second standard current value, and if a fourth current value detected by the current detecting section is not larger than the second standard current value, and conducts control to stop operations for image forming if the detected temperature is smaller than the standard temperature or if the detected electricity consumption is smaller than the standard electric power.

* * * * *